US005290155A

United States Patent [19]

Snow et al.

[11] Patent Number: 5,290,155

[45] Date of Patent: Mar. 1, 1994

[54] POWER STEERING PUMP WITH BALANCED PORTING

[75] Inventors: Douglas G. Snow, Walled Lake; Jerry L. Wilson, Farmington, both of Mich.

[73] Assignee: Deco-Grand, Inc., Royal Oak, Mich.

[21] Appl. No.: 919,201

[22] Filed: Jul. 24, 1992

Related U.S. Application Data

[63] Continuation-in-part of Ser. No. 753,755, Sep. 3, 1991.

[51] Int. Cl.[5] ..... F01C 21/00

[52] U.S. Cl. ..... 418/82; 418/131; 418/133; 418/135; 418/268; 417/310

[58] Field of Search ..... 417/310; 418/131, 133, 418/82, 135, 268

[56] References Cited

U.S. PATENT DOCUMENTS

| | | | |
|---|---|---|---|
| 2,212,833 | 8/1940 | Huber . | |
| 2,856,861 | 10/1958 | Adams et al. . | |
| 2,910,944 | 11/1959 | Pettibone . | |
| 3,022,794 | 2/1962 | Pippenger . | |
| 3,386,648 | 6/1968 | Van Rossem . | |
| 3,403,630 | 10/1968 | Clark et al. . | |
| 3,645,647 | 2/1972 | Clampa et al. . | |
| 3,728,046 | 4/1973 | Clark et al. | 418/135 |
| 3,788,783 | 1/1974 | Rosaen . | |
| 3,822,965 | 7/1974 | Drutchas et al. | 418/135 |
| 3,964,844 | 6/1976 | Whitmore et al. | 418/133 |
| 4,038,997 | 8/1977 | Smith . | |
| 4,408,964 | 10/1983 | Mochizuki et al. . | |

(List continued on next page.)

FOREIGN PATENT DOCUMENTS

| | | | |
|---|---|---|---|
| 2097475 | 4/1982 | United Kingdom | 418/268 |

OTHER PUBLICATIONS

Sperry Vickers, "Industrial Hydraulics Manual", First Edition, Sep. 1970 (18 pages).

Sperry Vickers, *Vane Pump & Motor Design Guide*, "Applying Vane Units", 1976 (9 pages).

Vickers Mobile Hydraulics Manual M-2976-S, 1st Edition 1967, Edited by Basal, pp. 24-53.

"1960-1963 Vickers Corp. Jet Final Fuel Model No. 4V317L003". (Shown in Four Photographs and Two Sketches).

*Primary Examiner*—Richard A. Bertsch
*Assistant Examiner*—Alfred Basichas
*Attorney, Agent, or Firm*—Harness, Dickey & Pierce

[57] ABSTRACT

The balanced vane hydraulic pump designed for automotive power steering applications employs a two-piece aluminum housing construction, a cam ring, rotor flow regulating valve, a high pressure gallery, and a pressure plate, all located in the rear housing section, and a set of needle bearings located in the front housing section for supporting the pump drive shaft from one end only. The pressure plate has a sculpted portion which communicates with the cam ring side of the pressure plate. The sculpted portion is a wishbone-shaped gallery and a low pressure area, recessed within the face of the pressure plate. The pressure plate also includes high pressure windows which deliver high pressure fluid from the cartridge to the high pressure gallery located within the rear portion of the pump housing. An important feature of the pressure plate is that it uses hydraulically balanced low pressure and high pressure passageways which are contoured to efficiently direct the moving fluid within the pump which aides in minimizing the loss of energy within the pump's passageways. The front housing member, rear housing member and also the pressure plate, all employ a common symmetrical wishbone-shaped gallery as a low pressure fluid passageway which causes balanced low pressure hydraulic fluid to be delivered to two pairs of two diametrically opposed inlet windows adjacent to the low pressure inlet sectors of the cam ring. In an alternative embodiment, a thrust plate is located in the front housing member and encompasses similar wishbone-type low pressure galleries.

21 Claims, 10 Drawing Sheets

U.S. PATENT DOCUMENTS 4,416,598 11/1983 Merz ..... 418/133
4,429,708 2/1984 Struch .
4,470,762 9/1984 Wondler .
4,470,764 9/1984 Anderson et al. .
4,470,765 9/1984 Hegler .
4,470,766 9/1984 Masica et al. .
4,470,768 9/1984 Konz ..... 418/133
4,473,341 9/1984 Ohe et al. .
4,478,237 10/1984 Blake et al. .
4,505,655 3/1985 Honaga et al. .
4,538,966 9/1985 Nikaido .
4,538,976 9/1985 Shibuya .
4,564,338 1/1986 Ilg .
4,573,890 3/1986 Hadama et al. .
4,621,986 11/1986 Sudo .
4,770,612 9/1988 Teubler ..... 418/133
4,772,190 9/1988 Merz et al. .
4,801,251 1/1989 Nakajima et al. .
4,804,317 2/1989 Smart et al. .
4,838,767 6/1989 Ohe et al. .
4,842,500 6/1989 Fujie et al. .
4,859,154 8/1989 Alhara et al. .
5,017,097 5/1991 Nakajima .
5,171,131 12/1992 Niemiec ..... 417/310

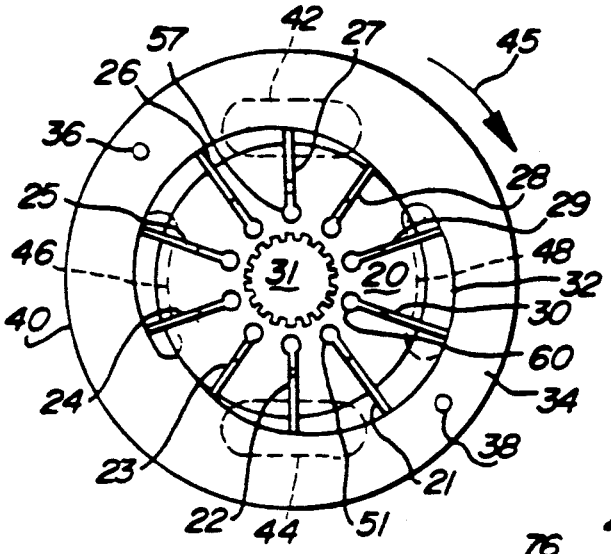
Fig-1
PRIOR ART
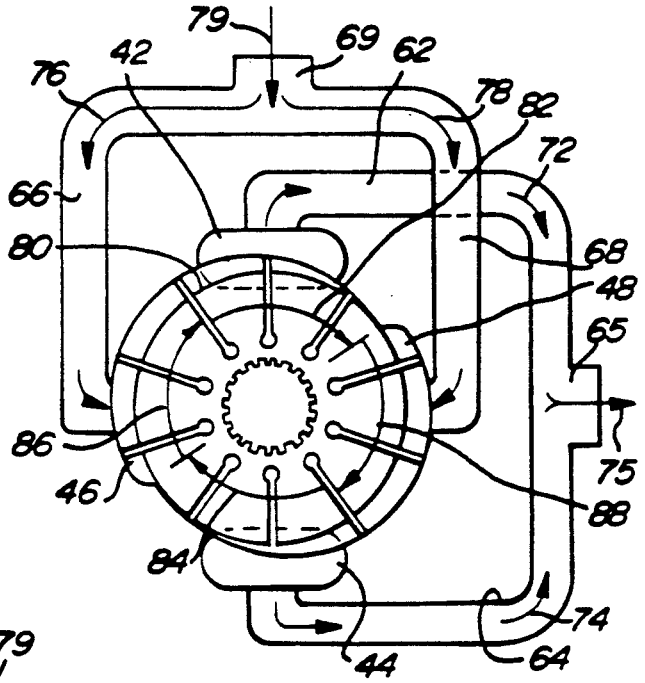
Fig-2
PRIOR ART
Fig-3
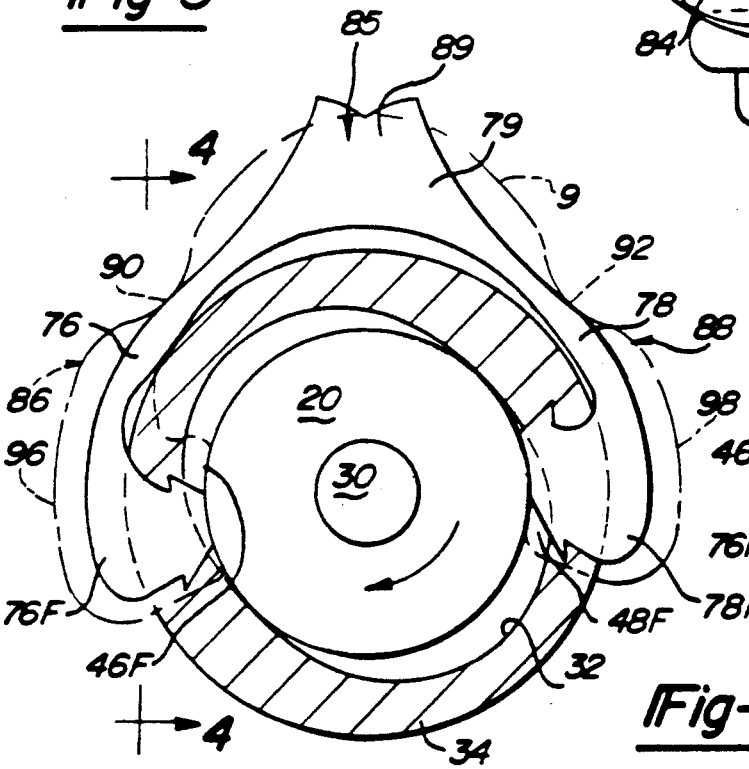
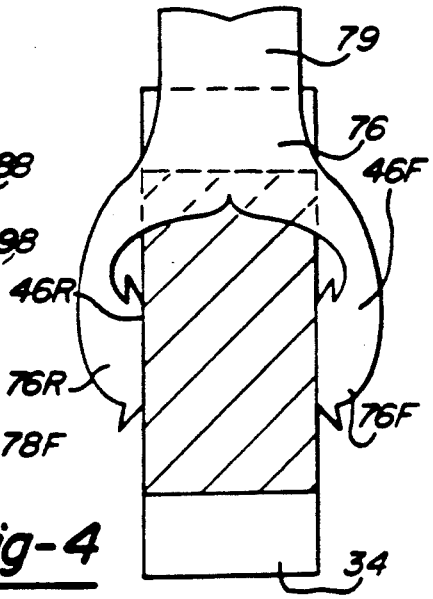
Fig-4

POWER STEERING PUMP WITH BALANCED PORTING

CROSS-REFERENCE TO RELATED APPLICATION

This application is a continuation-in-part of co-pending application Ser. No. 07/753,755 filed Sep. 3, 1991 and entitled "Power Steering Pump With Balanced Porting", the disclosure of which is incorporated herein by reference.

BACKGROUND OF THE INVENTION

1. Field of the Invention

This invention relates in general to hydraulic power steering pumps of the balanced vane type for use in automotive or mobile equipment applications, and in particular to hydraulic, power steering pumps having balanced low-pressure porting and a pressure plate.

2. Description of Related Art

Conventional balanced vane hydraulic pumps used in power steering applications have a generally cylindrical steel rotor with multiple vanes rotating within an oval path that is machined into a powdered iron cam ring. This mechanical arrangement is shown in simplified form in FIG. 1, where the rotor 20 has ten vanes 21–30 which rotate under power provided through a splined drive shaft 31. The outer edges of the vanes 21–30 are generally beveled or otherwise sharpened to a straight edge, and follow the generally elliptical machined inner surface 32 of cam ring 34 which is held in place relative to the pump housing (not shown in FIG. 1) by locator pins 36 and 38. The outer shape 40 of cam ring 34 is normally cylindrical. The high pressure outlet ports or "windows" 42 and 44 are shown in dashed lines at the top and bottom of the cam ring diametrically opposite to one another. The direction of pressure outlet ports or "windows" 42 and 44 are shown in dashed lines at the top and bottom of the cam ring diametrically opposite to one another. The direction of rotor rotation is clockwise as indicated by arrow 45 in FIG. 1. The inlet ports or windows 46 and 48 are shown in dashed and solid lines and are diametrically opposite to one another, on the left side and right side respectively of cam ring 34.

In a conventional balanced vane pump, each vane is pressed outwardly against the inner surface 32 of the cam ring 34 by centrifugal force, and slides in and out within its own radially-aligned slot in rotor 20, as it spins around the cam ring. Hydraulic assist is provided via high pressure hydraulic fluid ported to undervane holes 51–60 in the rotor, which are respectively associated with vanes 21–30, and are part of the undervane porting system, to help ensure that the vanes faithfully track the inner surface 32 of the cam ring 34.

FIG. 2 is a hydraulic diagram showing the fluid circuit coupling the two sets of diametrically-opposed ports or windows. Outlet ports 42 and 44 are respectively connected by conduits 62 and 64 to a common high pressure gallery 65. Inlet ports 46 and 48 are connected by conduits 66 and 68 to a common low pressure gallery 69. High pressure hydraulic fluid discharged from ports 42 and 44 flows as indicated by broad arrows 72 and 74 into one stream of fluid indicated by arrow 75 to a pressure relief and flow control valve (not shown in FIGS. 1 or 2) which is normally built into the pump housing. Low pressure fluid discharged from the relief valve or obtained from a hydraulic reservoir which is indicated by arrow 79, is divided into two flows indicated by arrow 76 and 78 and passed to the inlet ports 46 and 48.

The two discharge ports 42 and 44 are 180° apart, as are the two inlet ports 46 and 48. Thus, pressures radially applied against the generally circular outer edge 80 of rotor 20 cancel each other. In this manner, forces on the rotor are largely balanced in a radial direction. Since two sets of ports are used, balanced vane pumps indicated by arrows 82 and 84 have two discharge or pumping quadrants or sectors 82 and 84, which discharge oil into outlet ports 42 and 44 respectively, and have two inlet quadrants or sectors, indicated by arrows 86 and 88, which respectively draw in fluid through inlet ports 46 and 48.

The displacement of a balanced vane pump, that is, its volumetric output per revolution, is fixed and depends on the width of the cam ring (which is the same as the width of the rotor), and the throw of the cam ring. Balanced vane pumps provide large displacements in a relatively small size package, especially since this type of pump can be operated at high speeds. Vane pumps are popular because of their small size, good efficiency, durability, capacity and speed ranges. Balanced vane pumps produce output pulsations that are low in amplitude, with a frequency corresponding to the number of vanes times the revolutions per second of the pump shaft. Conventional vane pumps are fairly quiet, but are known to whine at high speed.

Power steering pumps of the balanced vane type used in the automotive industry and mobile equipment industry typically include a pump cartridge sandwiched between a pressure plate in the cover of the pump housing and a thrust plate in the body of the pump housing. The pump cartridge consists of these two plates, the cam ring, rotor, and vanes. Internal porting is provided in the pump which allows the high pressure hydraulic flow created by the pump as ft operates to bear against the pressure plate. The pressure plate in turn bears against the cam ring in order to control clearances as pressure output increases. Specifically, this provides hydraulic squeeze which maintains or even reduces the operating clearance provided between the cam ring, rotor and vanes on the one hand and the thrust plate or pressure plate on the other hand as the hydraulic pressure increases. In this manner, pump efficiency and pressures obtainable are increased since significant leakage from one pumping chamber to the next which otherwise would occur is prevented. However, the use of the pressure and thrust plate concept increases the costs of manufacturing a power steering pump since these parts must be machined and assembled.

For the last fifteen years or so within the automobile industry, there has been an intense desire to reduce weight and manufacturing costs while maintaining or improving upon car performance. It is the primary object of the invention described in the co-pending application to provide a simplified balanced vane power steering pump which satisfies these goals. In particular, primary objectives of that invention included the following:

(1) to reduce the weight of the power steering pump by making the pump from fewer parts, and by making sections of the housing from lightweight metal castings or other lightweight materials;

(2) to reduce manufacturing costs of the power steering pump by eliminating some of the machining operations required to make the housing and cover of a conventional power steering pump; and (3) to reduce the noise levels produced by the power steering pump, particularly at high speeds where conventional pumps are known to whine, by using a radially and axially balanced low pressure and high pressure porting systems.

Still other objectives of the invention in the co-pending application are to provide a power steering pump with reduced cavitation at high speeds by reducing turbulence through the use of contoured and generally symmetrical galleries and passages to deliver low-pressure hydraulic fluid to four inlet windows.

The primary objective of the invention described in this application includes the following:

(1) to provide a power steering pump with reduced cavitation at high speeds by reducing turbulence through the use of a sculpted pressure plate; and (2) to provide a power steering pump that utilizes a pressure plate and/or a thrust plate for improved pumping efficiency by providing balanced low pressure flow and smooth transition porting on both sides of each of the two low pressure regions within the pump.

SUMMARY OF THE INVENTION

In light of the foregoing problems and in order to furl the foregoing objectives, there is provided an improved balanced vane power steering pump that employs a balanced low pressure porting while utilizing a sculpted pressure plate as described in detail below and depicted in the FIGS. 16 thru 22. This improved balanced vane hydraulic pump realizes four low pressure inlet windows and four high pressure discharge windows. However, as distinguished from the co-pending application, this improvement locates two low pressure inlet windows within the face of a pressure plate while locating two high pressure discharge windows in the face of the pressure plate. The pressure plate also utilizes high pressure undervane ports which delivers high pressure fluid from the high pressure region of the rear pump housing to the underneath side of the vanes located within the rotor. The balanced vane pump includes: a pump housing; regulating valve means located within the pump housing; a pump drive shaft extending at least partially through the pump housing. More importantly, this balanced vane pump includes a two-piece housing, i.e. a front pump housing and a rear pump housing as well as a pressure plate, each of which has its own low pressure passage means. These low pressure passage means are arranged such that they define a balanced low pressure flow and smooth velocity transition portion system which delivers fluid on both sides of each of the two pressure regions within the pump.

According to a second aspect of the power steering pump of the present invention, there is provided a balanced vane hydraulic pump which includes: a pump housing; regulating valve means located within the pump housing; a pump drive shaft; a cam ring; a rotor; vanes; a pressure plate; and a thrust plate. The pressure plate and the thrust plate are two separate components which are fixed to the front housing member, and the cam ring through the use of locator pins. Most importantly, this pump has configured within the face of the thrust plate and the pressure plate, high pressure ports, undervane holes, and low pressure passage means. The front and rear pump housings also have a low pressure passage means.

These and other advantages, objects and aspects of the present invention may be further understood by referring to the detailed description, accompanying figures, and appended claims.

BRIEF DESCRIPTION OF THE DRAWINGS

The drawings show the preferred embodiments of the invention claimed in the co-pending application and in the present application. The description of the preferred embodiments are to be read in conjunction with the drawings. Like reference numerals designate the same or similar components or features in the various Figures, where:

FIG. 1 is a conventional mechanical diagram to illustrate the principles of operation of a balanced vane pump;

FIG. 2 is a conventional hydraulic diagram to help illustrate the principles of operation of a balanced vane pump;

FIG. 3 is a simplified cross-sectional view of the inside of a balanced vane pump of the co-pending application illustrating the balanced flow of low pressure fluid around the cam ring to inlet sectors located on opposite sides of the cam ring;

FIG. 4 is a simplified cross-sectional view of the FIG. 3 diagram taken along line 4—4 of FIG. 3 illustrating the balanced flow of low pressure fluid into a pair of inlet windows located in the same low pressure sector of the pump;

DETAILED DESCRIPTION OF THE PREFERRED EMBODIMENTS

Figure 5:
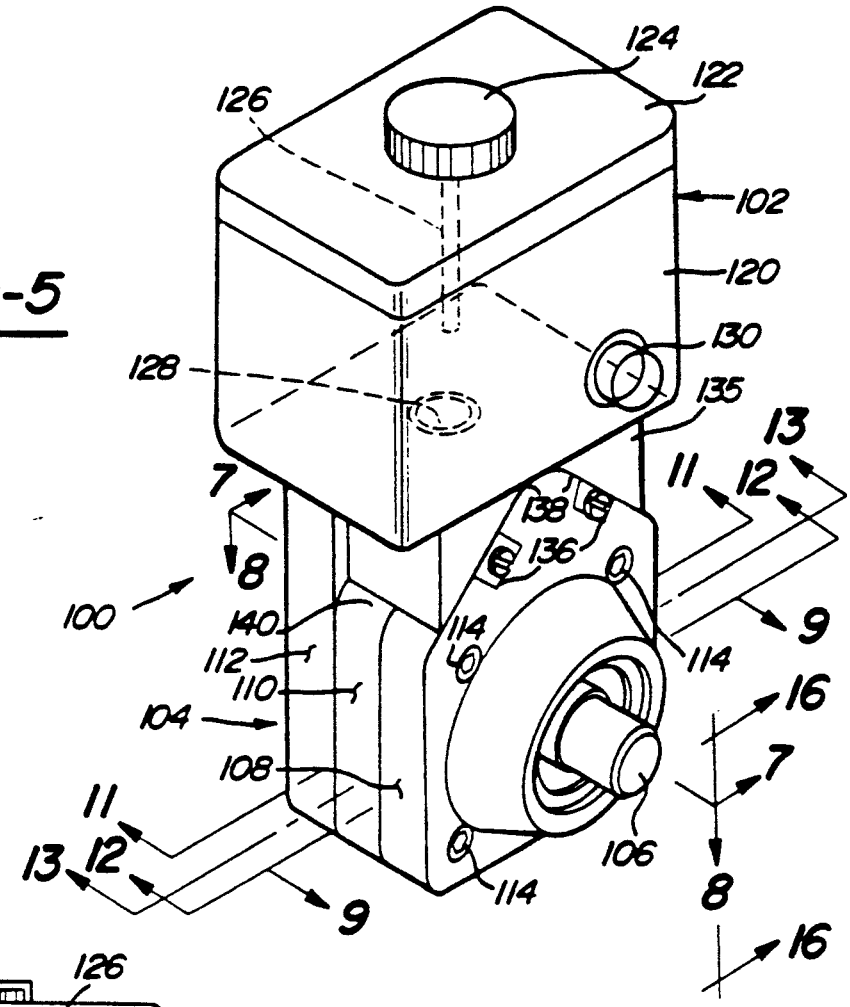
FIG. 5 is a perspective view of an assembled power steering pump of the co-pending application showing a hydraulic reservoir on top of the pump housing, which is formed of front, center and rear housing sections, with the drive shaft of the pump projecting out from the front housing section.

FIGS. 3 through 15 illustrate preferred embodiments of the invention, disclosed in the co-pending application. FIGS. 16 through 22 illustrate preferred embodiments of the invention of the present application. These illustrations are exemplary of but not the only ways in which the novel balanced vane pump claimed in the co-pending application and this application may be implemented.

FIGS. 3 and 4 illustrate face and side cross-sectional views of the cam ring and rotor of the co-pending application with broad arrows which diagrammatically show the balanced flow path to the four inlet windows that provide hydraulic fluid to the two low-pressure quadrants of the pump. For simplicity's sake, the vanes are not shown in FIG. 3. In FIG. 3, the incoming stream 79 of low-pressure hydraulic fluid is shown dividing into two streams 76 and 78 on left and right sides respectively of cam ring 34 to enter low-pressure sectors 46 and 48. The mechanism by which the flow is so divided is a gallery 85 shown in phantom and having a wishbone shape, which is located primarily in the center section of the pump housing, which will be described shortly. This wishbone gallery 85 has two bone-like or elongated side concourses 86 and 88 connected to a main concourse 89. The side concourses 86 and 88 respectively neck down at locations 90 and 92 and then widen again at lower portions 96 and 98 respectively. As shown in FIG. 4, the stream 76 flowing into the left concourse 86 of wishbone gallery 85 is further evenly divided into front and rear streams 76F and 76R which respectively enter front and rear inlet windows 46F and 46R of the low-pressure inlet sector 46 of the pump. The wishbone gallery 85 preferably has a smooth, contoured design as shown which helps reduce flow discontinuities and abrupt changes in fluid velocity as the fluid courses through passages 86 and 88. It may also help reduce operating noise of the pump. Further dividing each of the left and right streams 76 and 78 into front and rear streams (like streams 76F and 76R) so that low-pressure fluid is supplied evenly to the front and rear sides of the cam ring is also believed to be an innovation. It is believed to help balance axial as well as radial hydraulic forces on the rotor 20. This wishbone gallery design provides a balanced flow inlet system within a three-piece housing configuration in a minimum package size with good high speed capabilities. How these innovations may be implemented in balanced vane pumps will be made clear below.

Figure 6:
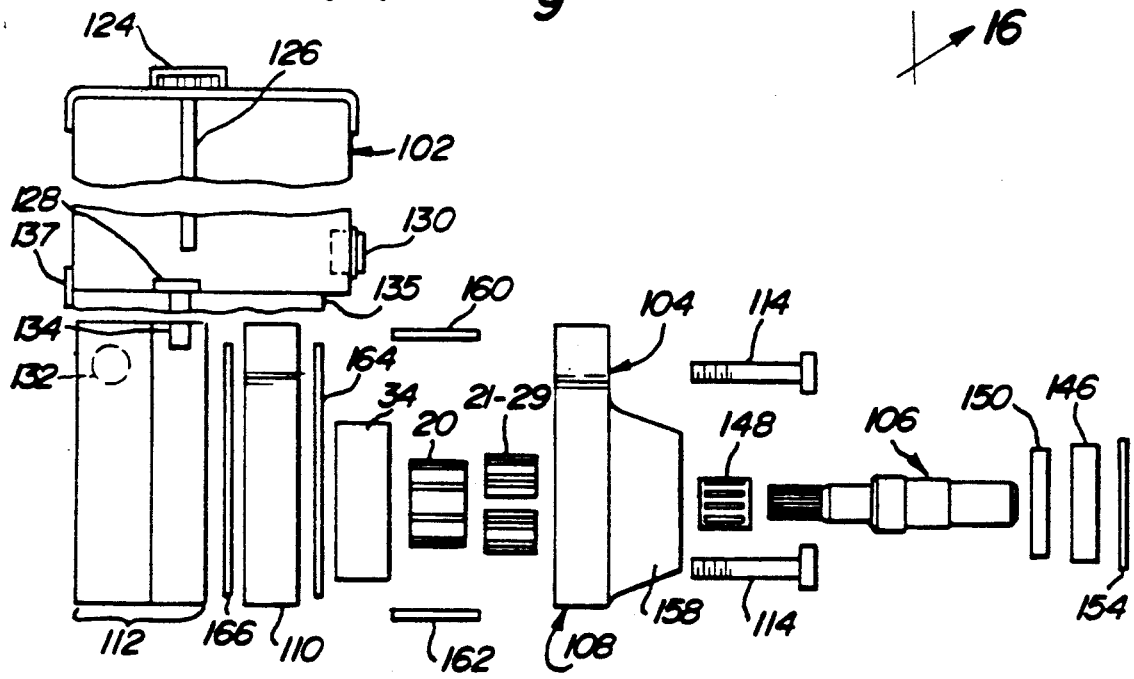
FIG. 6 is a simplified exploded view of the FIG. 5 pump showing various components of the pump.
Figure 7:
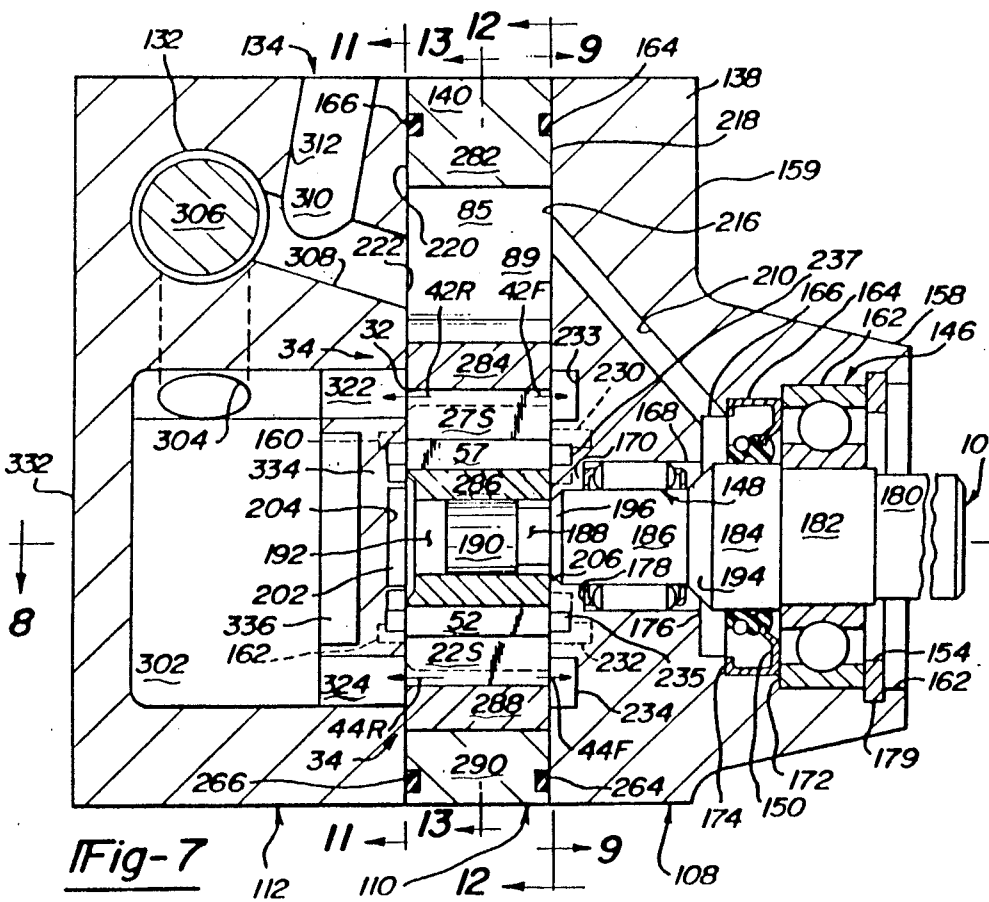
FIG. 7 is a vertical cross-section of the FIG. 5 pump taken along line 7—7, and showing some of the hydraulic passages, galleries and components in the pump housing, including a flow regulating valve in the rear housing section, the rotor and vanes in the center section, and the two sets of bearings in the front section.

FIG. 5 shows a perspective view of an assembled balance vane hydraulic pump 100 of the co-pending application. Pump 100 includes reservoir assembly 102 attached to a pump housing 104 which has a pump drive shaft 106 extending therefrom. The pump housing 104 is preferably formed in three separately cast sections, namely, front housing section 108, center housing section 110 and rear housing section 112. Housing sections 108 and 112 are held together, with center housing section 110 sandwiched in between, by fastening means 114, such as steel hex nut head bolts, SAE grade 5 or better. The reservoir 102 includes a base section 120 which is preferably formed of a translucent plastic material, and a cover 122 provided with a filler/breather cap 124. The cover 122 is preferably permanently attached to the base 120. A dip stick 126 may be connected to the cap 124 for readily measuring the level of the hydraulic fluid. A leak-proof coupling 128 is provided in the bottom of base 120 to allow fluid from the reservoir into opening 134 of the pump housing 104. A return line coupling 130 may be provided at any convenient location on the base 120 for receiving a low-pressure return line hose. Not shown in FIG. 5, but shown in FIGS. 6 and 7 is an opening 132 for the high-pressure discharge line for the pump. Any suitable coupling member may be press-fit, threaded or otherwise seated in opening 132 for permitting a hose or other type of hydraulic line to be connected thereto. The reservoir 102 also may include additional base support section 135 which wraps about the triangularly-shaped tops 138 and 140 of the front and center housing sections 108 and 110. Flat tabs 136 and 137 integrally molded into the base 120 of the reservoir may be provided for securing the reservoir 102 to the pump housing 104 by screws or rivets passing through the tabs into the housing.

FIG. 6, an exploded side view of pump 100, shows various components internal to the pump 100. Pump shaft 106 is supported entirely by the front housing 108 via ball bearing assembly 146 and roller or needle bearing assembly 148. A shaft seal 150, preferably of the lip seal type, is provided to prevent leakage of hydraulic fluid past the largest diameter of the shaft 106. A retaining ring 154 is used to hold the ball bearing assembly 146 in place within the truncated conical portion 158 of the front housing section 108. FIG. 6 also shows rotor 20, vanes 21-30 and cam ring 34. As in conventional power steering pumps, two steel locator pins 160 and 162 are provided to hold the cam ring 34 in place in the pump housing 104. Front and rear gasket means 164 and 166 are provided to seal the center housing 110 with respect to the front and rear housing sections 108 and 112.

FIG. 7 is an enlarged cross-sectional view of the pump 100 taken along lines 7—7 of FIG. 5, which shows details of the internal construction of the pump. Further features of the front, center and rear housing sections will now be described.

The front housing section 108 includes a generally trapezoidal rear portion 159 and the truncated conical portion 158 extending therefrom. Internally, the front section 108 has machined into it five diameters 162, 164, 166, 168 and 170 with each being smaller than the preceding diameter so as to form stop shoulders 172, 174, 176 and 178. Additionally, a rectangular groove 179 is machined into diameter 162 for capturing the retaining ring 154. The pump shaft 106 has several different diameters 180, 182, 184, 186, 188 and 190, and also has tapered conical areas 194 and 196 to permit the flow of hydraulic oil past these tapered regions. The diameter 190 is splined and engages corresponding a splined socket area of the rotor 20. The region 192 is empty, since the pump shaft 106 has no need to extend beyond splined diameter 190 because the pump shaft 106 is supported only by the bearing assemblies 146 and 148 in the front housing section 108. A pulley or other drive coupling member may be mounted to diameter 180 of pump shaft 106. Only a portion of the splines of rotor 20 need be engaged by the pump shaft 106. In a preferred embodiment, a centrally located region is engaged which permits mechanically balanced driving of rotor 20 without the pump shaft 106 restraining movement of rotor 20 in an axial direction.

The ball bearing race assembly 146 is located between diameters 162 and 182 of the front housing section and pump shaft. A conventional lip seal 150 provides a barrier for low-pressure hydraulic fluid by stationarily sealing housing diameter 164 while providing a rotating seal against diameter 184 of the pump shaft. The roller bearing assembly 148 is positioned between diameter 168 of the housing and diameter 186 of the pump shaft and is restrained against axial movement by stop shoulder 170 of the housing and by tapered surface 194 of the pump shaft 106. Lubrication to the roller bearing assembly 148 is provided by hydraulic fluid which leaks to low-pressure regions or pockets 202, 204 and 206 adjacent the splined area of rotor 20 from the high-pressure quadrants of the pump. This hydraulic fluid is drained past roller bearing assembly 148 to the annular volume whose outer periphery is defined by diameter 166 and stop shoulder 176 of the front housing 108, and by the lip seal 150. This annular volume is drained by diagonal drain line 210 which connects to the wishbone gallery 85 of center housing section 110 as shown.

Figure 9:
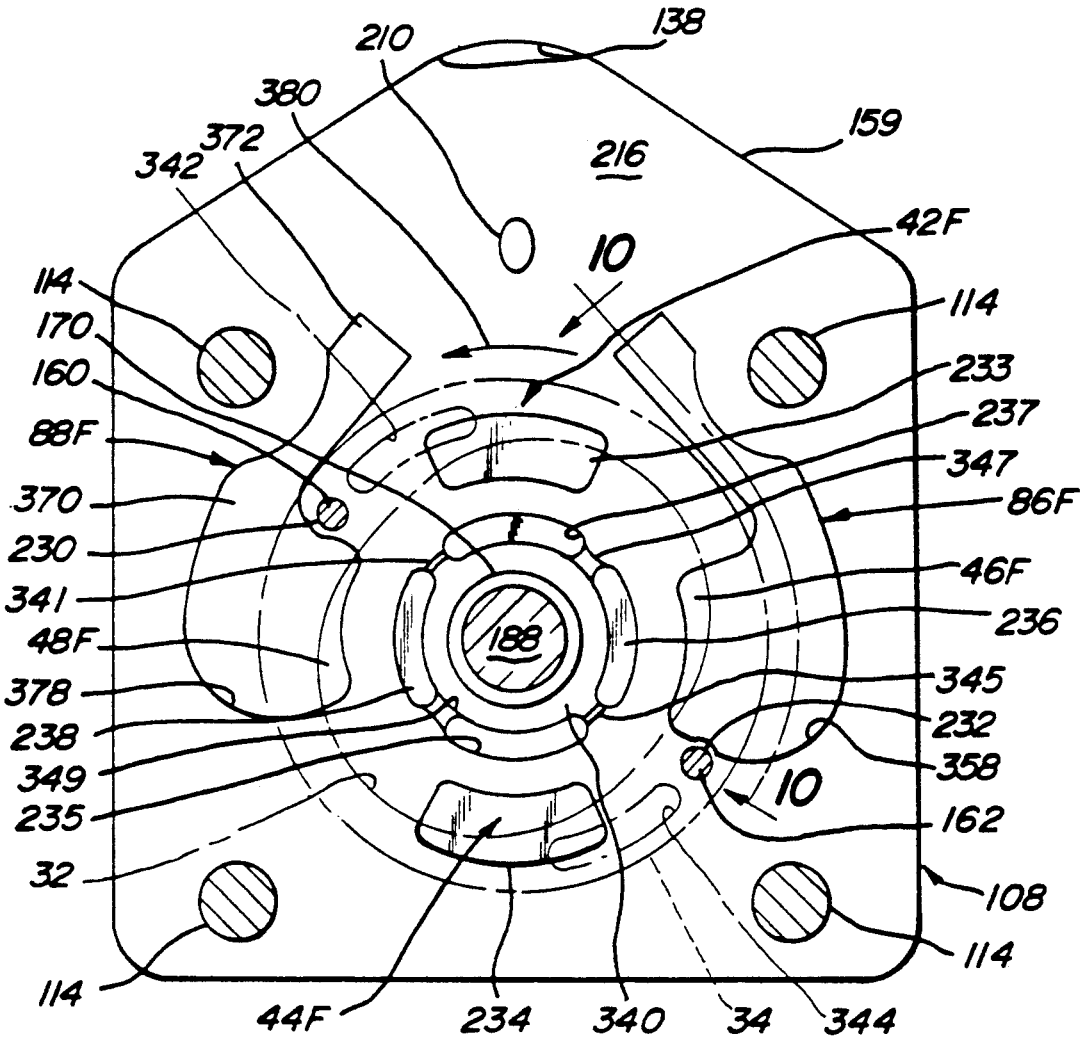
FIG. 9 is a cross-sectional view of the FIG. 5 pump taken along the line 9—9 of FIGS. 5 and 7 showing the high and low pressure passages provided in the inside face of the front housing section.
Figure 11:
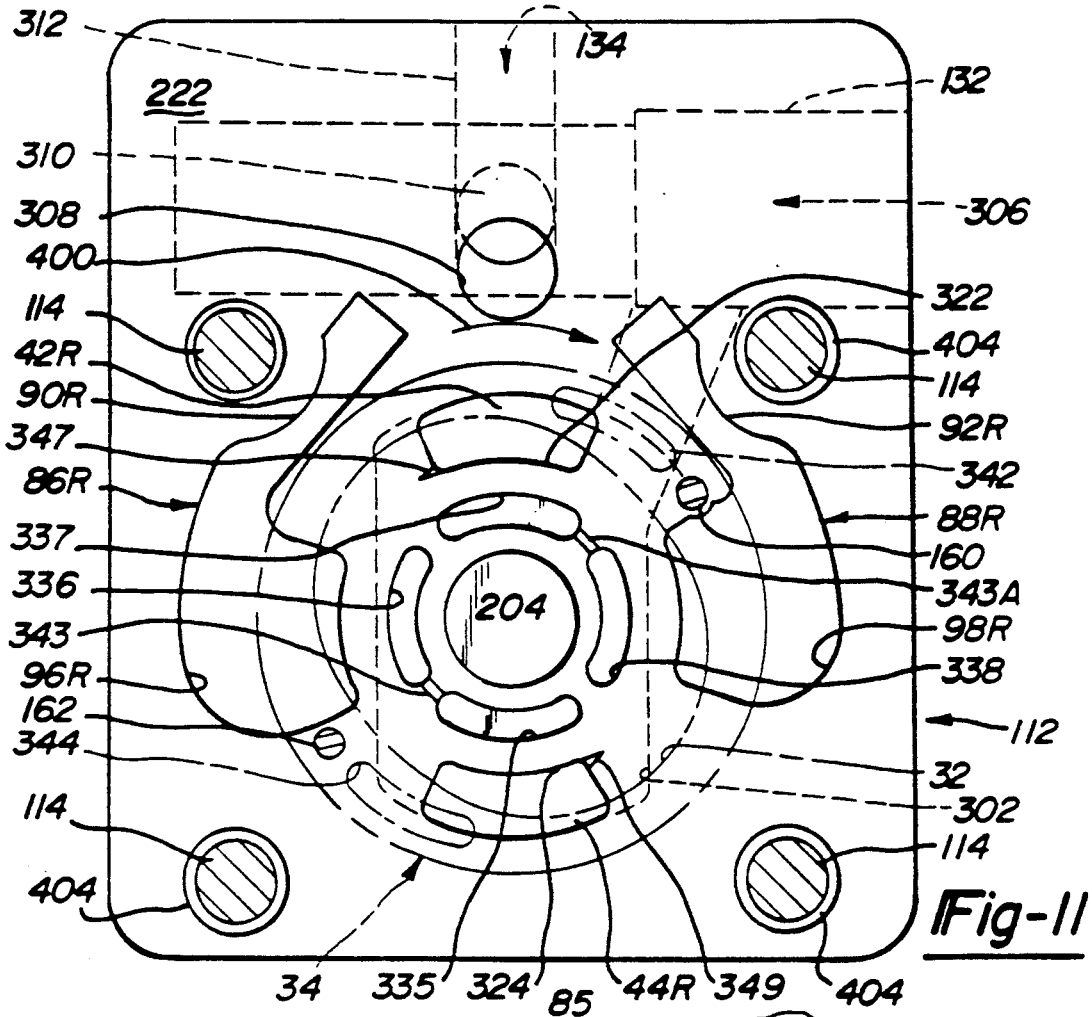
FIG. 11 is a cross-sectional view of the FIG. 5 pump taken along lines 11—11 of the FIGS. 5 and 7 illustrating the locations of the high pressure and low pressure passages provided in the inside face of the rear housing section.
Figure 12:
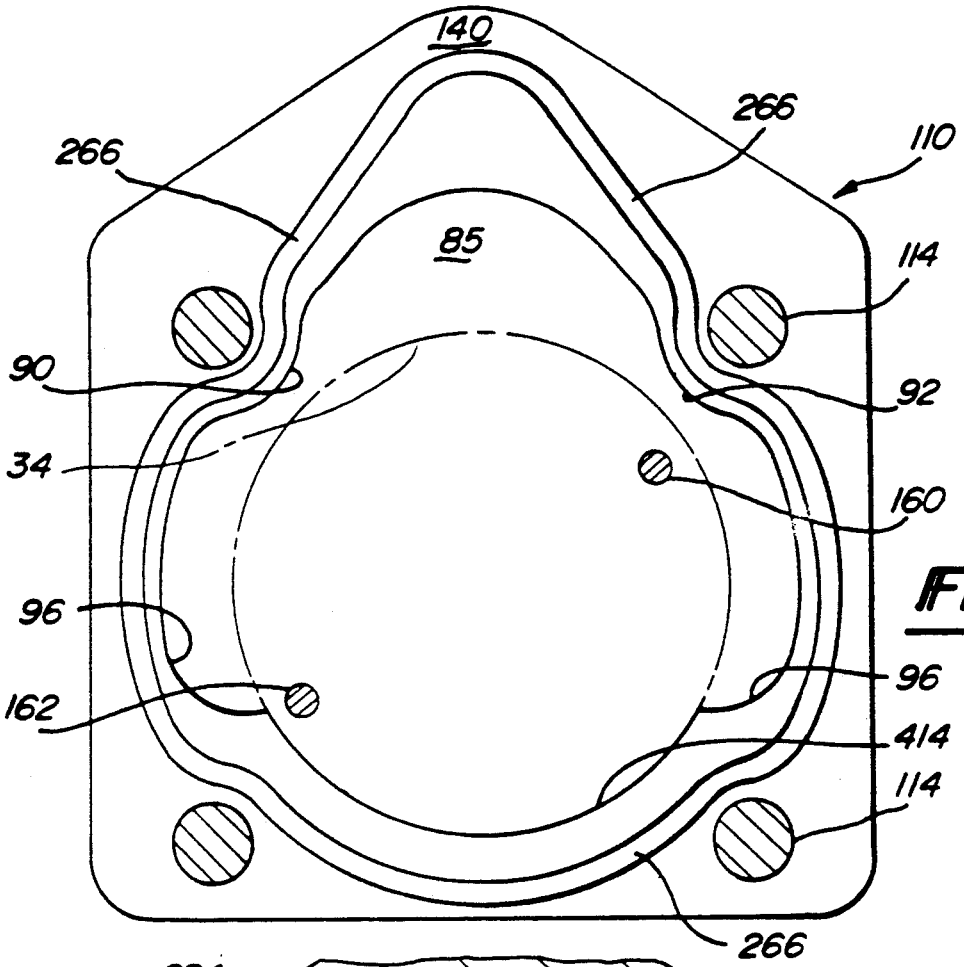
FIG. 12 is a cross-sectional view of the FIG. 5 pump taken along line 12—12 of FIG. 5 showing a front face of the center housing section, and its O-ring groove and the location of the wishbone gallery arranged about the top and sides of the cam ring shown in phantom.

The front housing section 108 has a substantially planar inner face or surface 216 shown in FIG. 9 which abuts up against a corresponding substantially planar face 218 of center housing section 110, which is best shown in FIG. 12. Similarly, the substantially planar face 220 on the opposite side of center section 110, which is identical to face 218, abuts against substantially planar inner face 222 of rear housing section 112, which is best shown in FIG. 11.

Figure 8:
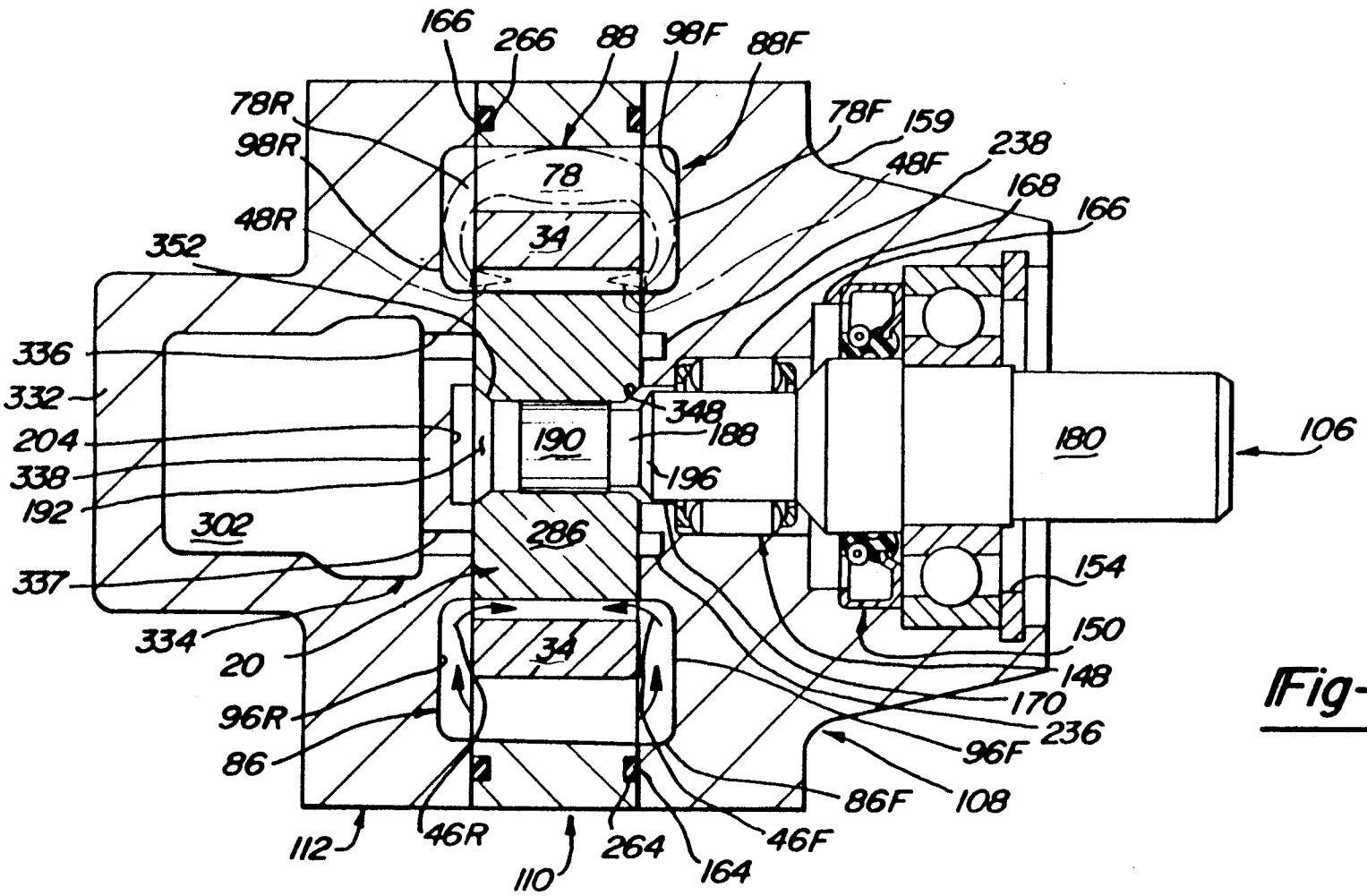
FIG. 8 is a horizontal cross-sectional view of the FIG. 5 pump taken along line 8—8 of FIGS. 5 and 7.

As can be understood by studying FIGS. 7, 8 and 9, the face 216 of front housing section 108 has formed in it ten blind openings, including: holes 230 and 232 for the cam ring locator pins 160 and 162; oblong openings 233 and 234 which permit hydraulic fluid to be discharged from windows 42F and 44F; sausage-shaped openings 235 through 238 which are part of the undervane porting system which will be further described; and elongated openings 86F and 88F which are the front parts of the concourses 86 and 88 of wishbone gallery 85 illustrated in FIG. 3.

In FIG. 7, center housing section 110 is shown as having continuous grooves 264 and 266 formed in the flat faces 218 and 220 respectively. These grooves are for 0-ring seals 164 and 166. The shape of grooves 264 and 266 are preferably substantially identical and may take a form as shown in FIG. 12 for groove 266.

In FIG. 7, in the center housing section of pump 100, there is shown, from top to bottom, the following: the top portion 140 of center housing section 110, the main concourse 89 of wishbone gallery 85, top portion 284 of cam ring 34, the slot 27S in rotor 20 for vane 27 and its associated undervane hole 57, annular splined region 286 of the rotor 20, undervane hole 52 and the associated lot 22S for vane 22, bottom portion 288 of the cam ring 20, and bottom portion 290 of the housing 110.

The rear housing section 112 shown in FIG. 7 includes an internal high pressure chamber 302 which is connected by a cylindrical passage 304 to chamber 132, which has a conventional flow control and relief valve 306 located therein, such as the valve used in the automotive power steering pumps made by the Saginaw Division of General Motors Corporation. The internal chamber 302 is connected by upper and lower high pressure passages 322 and 324 which form high-discharge windows 42R and 44R. The overall configuration of chamber 302 may be understood by studying FIGS. 7, 8 and 11. The rear housing section 112 also includes a bypass passageway 308 connected at location 310 to passage 312 leading to opening 134 which is the inlet port for reservoir 102.

As may be seen in FIGS. 7 and 8, rear housing section 112 has an external wall portion 332 and an internal wall portion 334 which is preferably thinned in its center region about the axis of the pump shaft 106 by a pocket chamber 336 which is preferably cylindrical and directly connected to chamber 302. This leaves a center region 338 of wall portion 334 as a thin wall section which can respond to hydraulic pressure within the chamber 302, thereby maintaining or reducing cam ring and vane clearances with the portion of the wall facing the rotor 20 and vanes 21-30. In this manner, the wall section 338, although an integral part of casting forming the rear housing section 112, can nevertheless serve as a semi-flexible pressure plate to maintain desired operating clearances at higher pressures. The thickness of the wall section 338 will depend on many factors, including the diameter of chamber 336 in comparison to the diameter of rotor 20 and precise shape of inner surface 32 of cam ring 34, the desired operating clearances between rotor 20 and faces 216 and 222 and the like. In the FIG. 7 embodiment of the co-pending application, desired operating clearances between the rotor and vanes on the one hand and each of the inner side surfaces 216 and 222 of the front and rear housing sections 108 and 112 on the other hand are preferably about 0.0005 inch to about 0.001 inch.

FIG. 9 is a vertical view of the FIG. 5 pump taken along line 9—9 of FIGS. 5 and 7. This view shows the inside face 216 of the front housing section 108, particularly the relationships between the various blind openings and the cam ring 34, which is shown in phantom superimposed upon the face 216. Readily identifiable components shown in this view include the four bolts 114 and the cam ring locator pins 160 and 162 which are slidably received into blind holes 230 and 232 in the face 216 of housing section 108. Also, the diameter 188 of the pump shaft is shown centered within diameter 170 within face 216.

Openings 235–238 of the undervane porting system are also visible, concentrically arranged about the diameter 170 and separated therefrom by a generally annular flat surface portion 350 of face 216. The porting to blind openings 235 and 236 is conventionally provided through the rotating undervane holes 51 through 60 within the rotor 20. Similarly, the porting to blind openings 233 and 234 is conventionally provided through oblong, sausage-like thru-holes 342 and 344 shown in phantom in the cam ring 34 in FIG. 9. The porting to low pressure inlet windows 46F and 48F is provided by blind openings 86F and 88F which form part of the wishbone gallery, as previously described.

Figure 10:
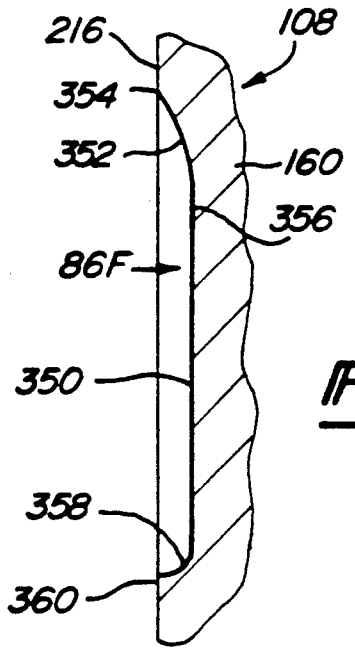
FIG. 10 is a partial cross-sectional view of the front housing section taken along line 10—10 of FIG. 9 showing the sloped and contoured low pressure inlet passageway region.
Figure 10A:
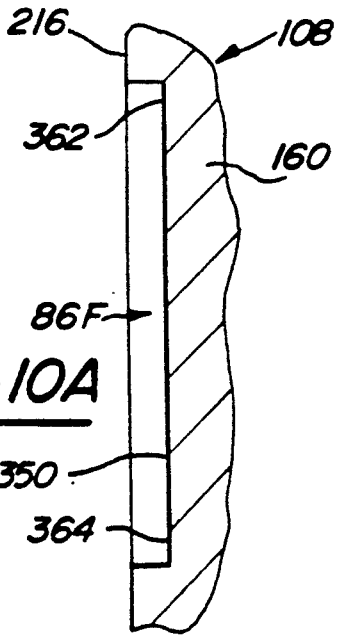
FIG. 10A is a partial cross-sectional view of the front housing section taken along line 10—10 of FIG. 9 showing an alternative construction for a low pressure inlet passageway.

FIG. 10 and FIG. 10A shows two alternate arrangements for the opening 86F shown in FIG. 9. Most of the bottom surface 350 in each of the openings 86F and 86F″ is flat and coplanar with respect to face 216. However, as shown in FIG. 10, the upper bottom surface 352 slopes from point 354 downward to area 356 in order to provide a gentle ramp so as to not introduce abrupt changes in the size of the opening 86F, which tend to introduce some turbulence in the fluid flow. Similarly, the bottom portion 358 of opening 86F describes a gentle arc, such as a quarter circle, to point 360 on the face 216 of housing section 108. In contrast, opening 86F″ shown in FIG. 10A does not provide gentle tapers at the top and bottom portions of the opening. Instead, abrupt upper and lower corners 362 and 364 are provided. These two abrupt corners will work, but are believed to possibly introduce fluid flow discontinuities and detract from efficient rapid flow of fluid through the opening 86F to the low-pressure inlet window 46F. The other opening 88F may be made generally as a mirror image of opening 86F, for balanced resistance to fluid flow.

Also, as may be seen in FIG. 9, the length of opening 86F is preferably made slightly greater than the length of opening 88F. This difference in length is deliberate and allows the fluid eventually provided to inlet window 46F slightly more space to slow down and turn around to match the direction of movement of the vanes 21–30 rotating with rotor 20. The broad arrow 380 near the top of FIG. 9 shows the direction of rotation of the rotor 20 with respect to the face 216. As such, it can be seen that the hydraulic fluid flowing downwardly through concourse 86F must change direction and flow upwardly with the vanes, whereas the hydraulic fluid through concourse 88F is carried in the same general downward direction as the rotating vanes. By lengthening and enlarging concourse 86F slightly with respect to concourse 88F, it is believed that more balanced hydraulic operation may be obtained, by substantially neutralizing the effect of the hydraulic fluid in concourse 86F changing direction. In other words, ft is believed that better balancing of the hydraulic forces experienced by the rotor 20 and vanes 21–30 is likely achieved in this manner.

FIG. 11 is a view of the face 222 of the rear housing section 112. The direction of rotation of the rotor and vanes with respect to this face is indicated by broad arrow 400. The location of the cam ring 34 in relation to the various openings and passages in the rear housing section 112 is shown by illustrating the cam ring 34 in phantom. The blind openings in rear housing section 112 are often mirror images of corresponding blind openings found in the face 216 of front housing section 108 shown in FIG. 9. For example, circular blind openings are provided for locator pins 160 and 162. In addition, openings are provided for the four bolts 114. The threaded end of the bolts 114 are screwed into corresponding threaded openings found in the rear housing section 112. In practice, it may be preferable to tighten the bolts past the yield strength of threads tapped into certain lightweight material out of which the rear housing section 112 may be made, such as aluminum. In such instances, it is preferred to use conventional steel threaded inserts 404 for greater bolt-holding strength.

Also shown in FIG. 11 are the undervane openings 335 through 338 which also provide fluid to the undervane holes 51–60 in the rotor 20. The undervane openings 336 and 338 are thru-holes and interconnect to high-pressure fluid chamber 302 of the rear housing section 112, which is shown in dashed lines in FIG. 11. The top and bottom undervane holes 337 and 335 are blind holes, in that they do not pass directly through to chamber 302. Instead, opening 337 is connected by control orifice or groove 343A to opening 338. Blind opening 335 is connected by control orifice or groove 343 to opening 336. In FIG. 9, similar narrow control grooves 341 and 345 are shown between undervane openings 237 and 238 and between undervane openings 235 and 236, respectively. Further, in FIG. 9 large, shallow control grooves 347 and 349 are shown between undervane openings 236 and 237 and between 235 and 238, respectively. Such control grooves of the type shown in FIGS. 9 and 11 are found on conventional power steering pumps from the Saginaw Division of General Motors. These control grooves help ensure that the vanes in the high-pressure sectors of the pump track properly with reduced noise. Also shown in FIG. 11 are lead-in control or metering grooves 347 and 349, which are also found in conventional balanced vane power steering pumps from General Motors.

FIG. 12 is a view of the face 218 of the center housing section 110. The cylindrical outer perimeter of the cam ring 34 is shown in phantom. The bottom section 288 of the housing includes a generally cylindrical arc 414 which matches the outer diameter cam ring 34 as shown. The shape of wishbone gallery 85 is clearly shown in FIG. 12, including the rounded lower regions 96. These regions 96 are contoured to be a gentle curve, such as a portion of an ellipse, to help smoothly deliver low-pressure fluid to inlet windows 46F and 46R and 48F and 48R respectively. The necked-down regions 90 and 92 of the gallery also represent gentle contours that help ensure that flow into the main course 89 of gallery 85 relatively evenly divide between the two legs or concourses 86 and 88.

Figure 13:
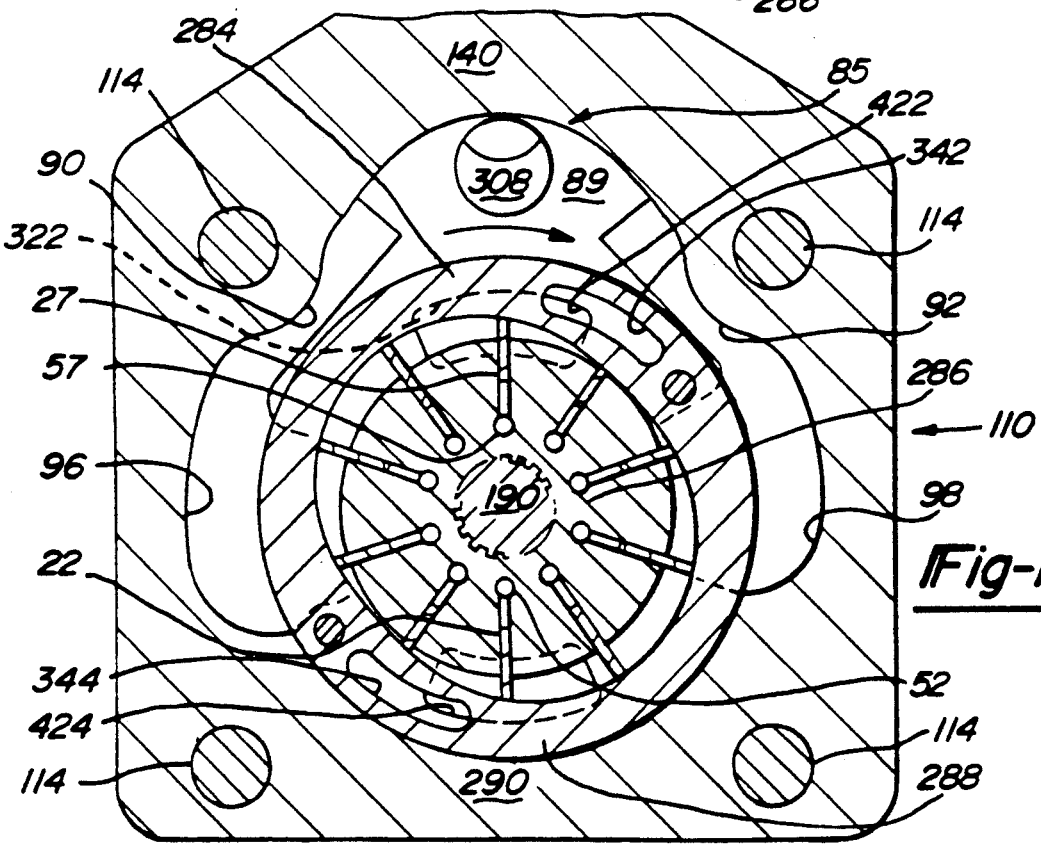
FIG. 13 is a cross-sectional view of the FIG. 5 pump taken along line 13—13 of FIGS. 5 and 7 showing the center housing section, the separate cam ring, rotor and vanes in operative relation with respect to one another and with respect to the high and low pressure passages of the inner face of the rear housing section respectively shown in phantom and in solid.

FIG. 13 is a vertical cross-sectional view through the center housing to section 110 taken along lines 13—13 of FIGS. 5 and 7 and showing the positional relationships between the wishbone gallery 85, the rotor 20 and vanes 21-30 and the cam ring 34. It also shows the oblong discharge overpass openings 342 and 344 passing axially through the cam ring 34. As may be seen, there is an overlap area 22 between oblong passages 342 and high-pressure passage 322 in the rear housing section 112. Similarly, there is an overlap area 424 between cam ring passage 344 and high-pressure passage 324 in the rear housing section 112. These overlap areas 422 and 424 may be varied in size, as is illustrated in FIG. 14 to reduce flow restrictions if desired.

The pump 100 just described with respect to FIGS. 3 through 13 may be constructed from any suitable or conventional materials. For example, the front, center and rear housing sections 108-112 may be made of any suitable grade of cast iron, but are preferably made of lightweight metal casting, such as 356-T6 aluminum, or even any suitable high-strength, high-temperature plastic or polymer material. The rotor may be made of any suitable metal, such as 8026 steel, and is preferably heat-treated, such as by carburization, to provide long-wearing surfaces. The vanes may be made or any suitable steel, such as air-hardened A2 or M2 tool steel. The cam ring 34 may be made out of sintered powdered iron using conventional processes. Its inner surface 32 may be precision ground to any desired shape and tolerance used in conventional power steering pumps. The pump 100 can be readily engineered to handle pressures up to about 2000 psi. A typical relief valve setting for automotive power steering applications is about 1200 to 1500 psi, and is readily achieved by pump 100.

Figure 14:
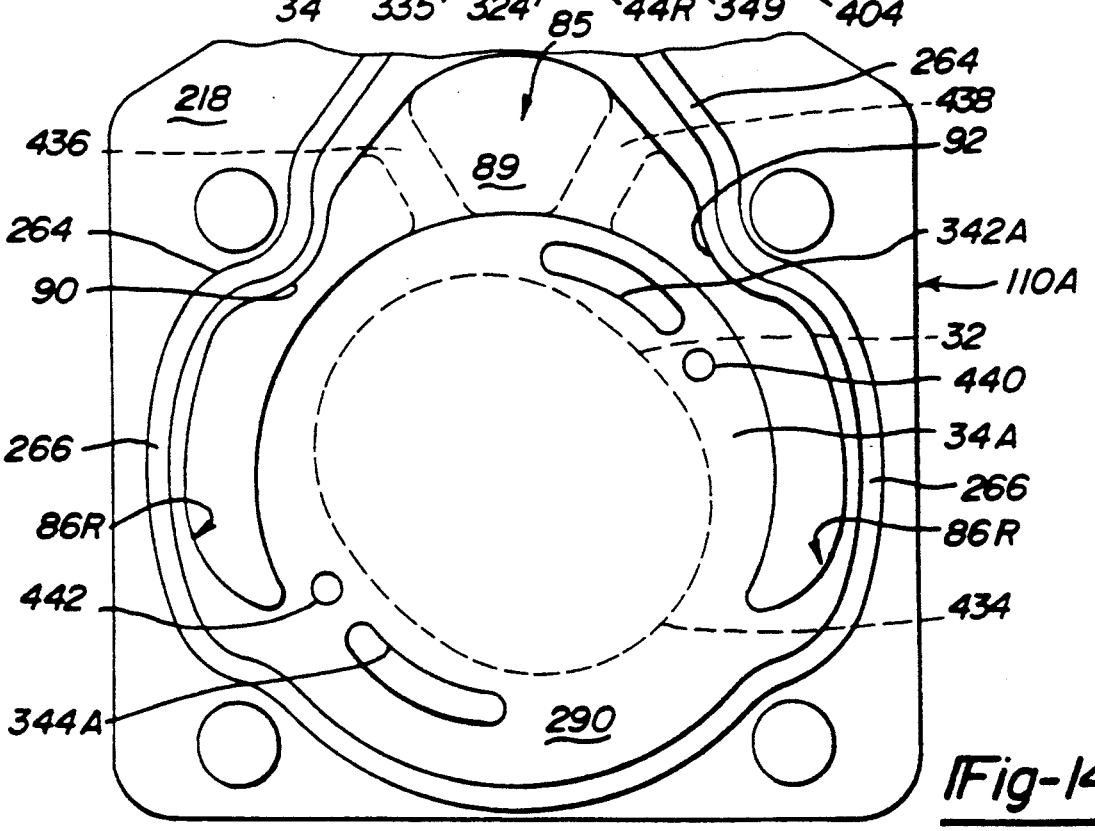
FIG. 14 is a view, from the same perspective as FIG. 12, of the cross-sectional view of the face of an alternative one-piece powdered-metal center housing section having an integral cam ring.

FIG. 14 shows an alternate embodiment 110A for the center housing section 110 and cam ring 34 described above as part of pump 100. Housing section 110A includes an integrally formed pump ring 34A which is made from the same material and at the same time as the rest of the housing section 110A. Housing section 110A is preferably made from any suitable or conventional cast metal material, such as powdered metal. With either material, it is desirable to harden the internal wear surface 32 to some suitable depth such as between about 0.001 inches and 0.010 inches. Such a surface can then be ground using conventional techniques to the required accuracy and shape for inner surface 32. Alternatively, it may be preferable to grind the surface 32 first, and then harden ft.

If necessary, the surfaces 218 and 220 on either side of the center housing section 110A may be made finished to any required level of smoothness or flatness by lapping or other techniques. If for any reason additional strength is required in cam ring 34A, integrally-formed webs 436 and 438 (shown in phantom) may be provided as shown in the main concourse 89 of wishbone gallery 85. In general, webs 36 and 38 are preferably a thin oval shape in radial cross-section, so as to restrict only to a minor degree the flow of stream 79 through the main concourse 89 of the wishbone gallery 85.

If desired in cam ring 34A, holes 440 and 442 for locator pins 160 and 162 respectively may be provided. Also, high pressure overpass discharge holes of oblong shape generally corresponding in location and size to holes 342 and 344 in cam ring 34 of FIG. 13 may be provided in cam ring 34A. Alternately, lengthened overpass holes 342A and 344A may be provided to enlarge the overlap areas 322 and 324 described with respect to FIG. 13, if desired.

Figure 15:
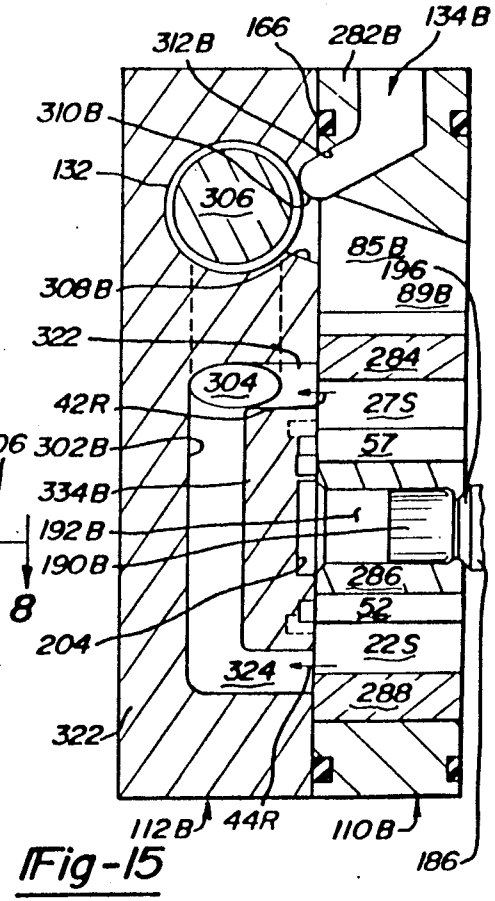
FIG. 15 is a vertical cross-sectional view, similar to FIG. 7, of the center and rear housing sections of the changed portions of an alternative balanced vane hydraulic pump of the co-pending application, which has shorter pump shaft and smaller rear housing section.

FIG. 15 is a cross-sectional view of yet another alternate embodiment of the hydraulic power steering pump of the co-pending application. In this embodiment, the center and rear housing sections are altered while the front housing section 108 and the portion of pump shaft 106 within housing section 108 remain unchanged. By way of introduction, note that chamber 302 shown in FIG. 7 is rather large, because the flow control and pressure relief valve is located some distance (about one inch) from the main concourse 89 of wishbone gallery 85. In order to reduce the weight and amount of material required to manufacture the rear housing section 108, the valve 306 may be moved much closer to the wishbone gallery 85. This in turn necessitates changes to the locations of inlet port 334 and connecting line 312 leading to passage 308. Thus, all of these features have been modified as shown in FIG. 15, and the suffix "B" has been appended to the reference numerals to identify each of these and other modified features. To the extent the features or components are unchanged, the same reference numeral found in FIG. 7 has been used. Other features modified in FIG. 15 from the FIG. 7 embodiment are that the wall section 334 in FIG. 7 has been increased in thickness so as to be substantially nonflexible in response to varying hydraulic forces within chamber 302B, and that the splined portion 190 of the pump shaft 106 has been moved to save material. These changes will be now described in further detail.

The movement of valve 306 toward the center housing section results in a very short connecting passage 308B to deliver relatively high velocity fluid being discharged from the valve 306 to the main gallery 89B. In order to achieve a venturi-like effect to help pull fluid from reservoir inlet port 134B into passage 308B, the connecting passage 312B is angled as shown on a diagonal from the center part of upper section 282B to an area 310B as close as practical to the high-pressure bypass outlet of valve 306. In this manner, a venturi effect which promotes efficient drawing of hydraulic fluid from the reservoir is achieved, as it is in the FIG. 7 arrangement of valve 306 and passageways 308 and 312.

Reduced-size high pressure chamber 302B is interconnected to high pressure connecting passages 322 and 324 and to intermediate passage 304, which delivers discharged high pressure fluid to the inlet of regulating valve 306. The thickness of wall section 334B is increased sufficiently to be non-flexing at expected maximum operating pressures such as 1500 to 2000 psi.

In order to lighten pump shaft 106, the non-splined diameter portion 188 of pump shaft 106 in FIG. 7 has been substantially eliminated. Thus external splined portion 190B engages only about one-half of the internal splined portion 286 of rotor 20. Thus, region 192B is empty of material, and fills with low-pressure hydraulic fluid.

Figure 21:
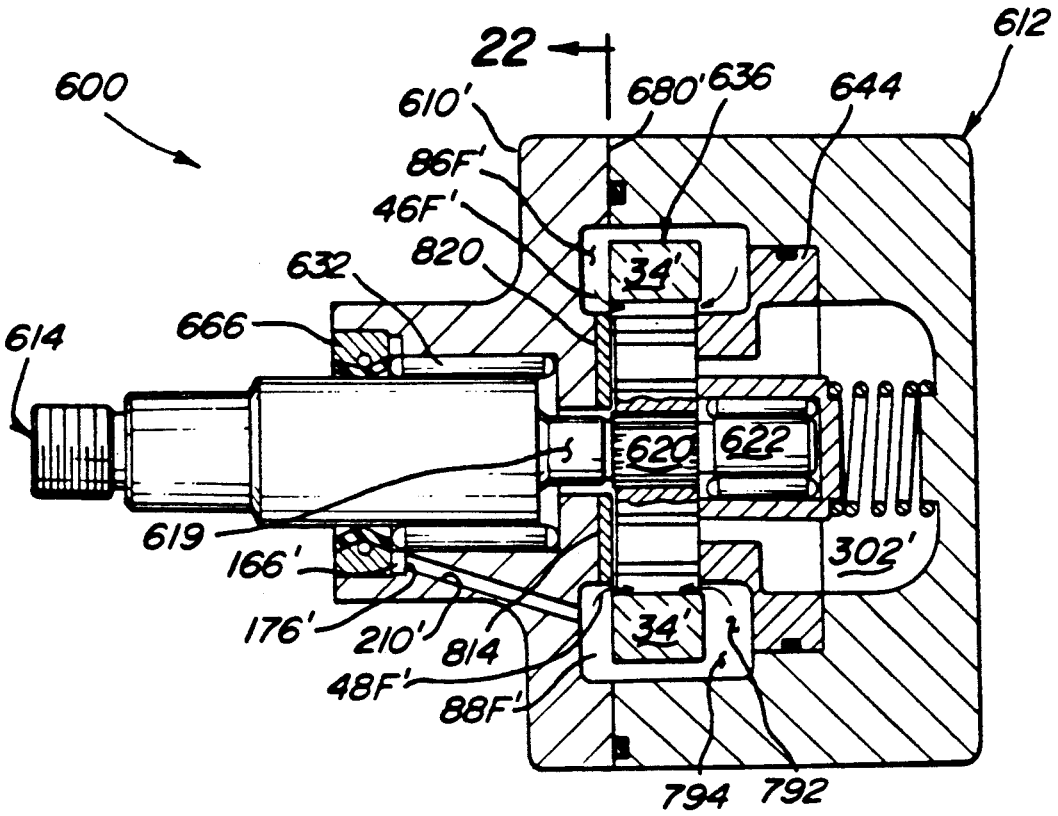
FIG. 21 is a horizontal cross-sectional view of the FIG. 16 pump taken along line 21—21 of FIG. 16.
Figure 22:
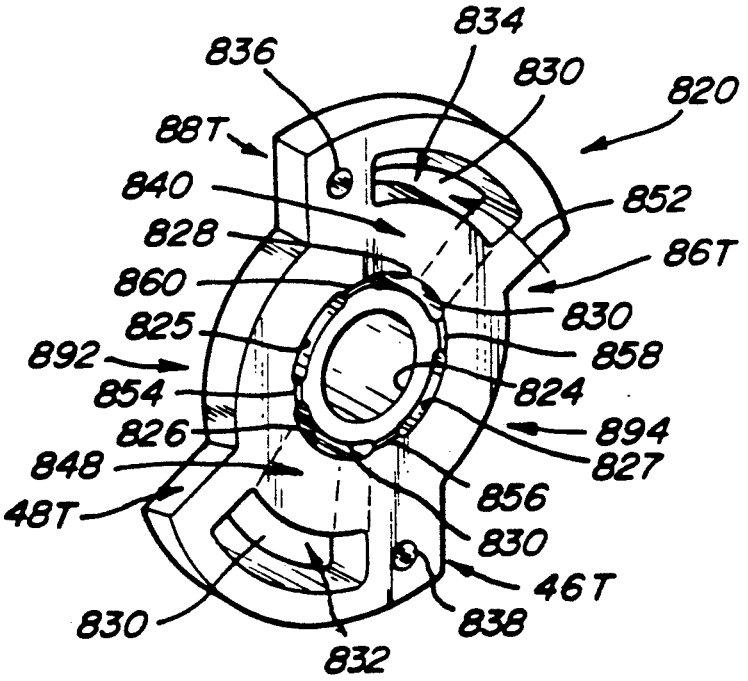
FIG. 22 is an enlarged view of the FIG. 21 pump taken along line 22—22 of FIG. 21 showing the front face of the thrust plate.

The claimed inventions in this application are directed toward novel light-weight reduced in size pumps and power steering pumps employing the balanced low pressure porting disclosed in the present application and utilizing a pressure plate and potentially a wear or thrust plates. The first embodiment utilizing the pressure plate is disclosed in FIGS. 16 through 20. This pressure plate is sculpted to provide for balanced low pressure flow and smooth velocity transition porting on both sides of each of the two low pressure regions within the pump. FIGS. 21 and 22 show a second embodiment using a pressure plate design, which includes an optional thrust plate, similar in configuration as the pressure plate, that may also be used in the power steering pumps disclosed in this application.

Figure 16:
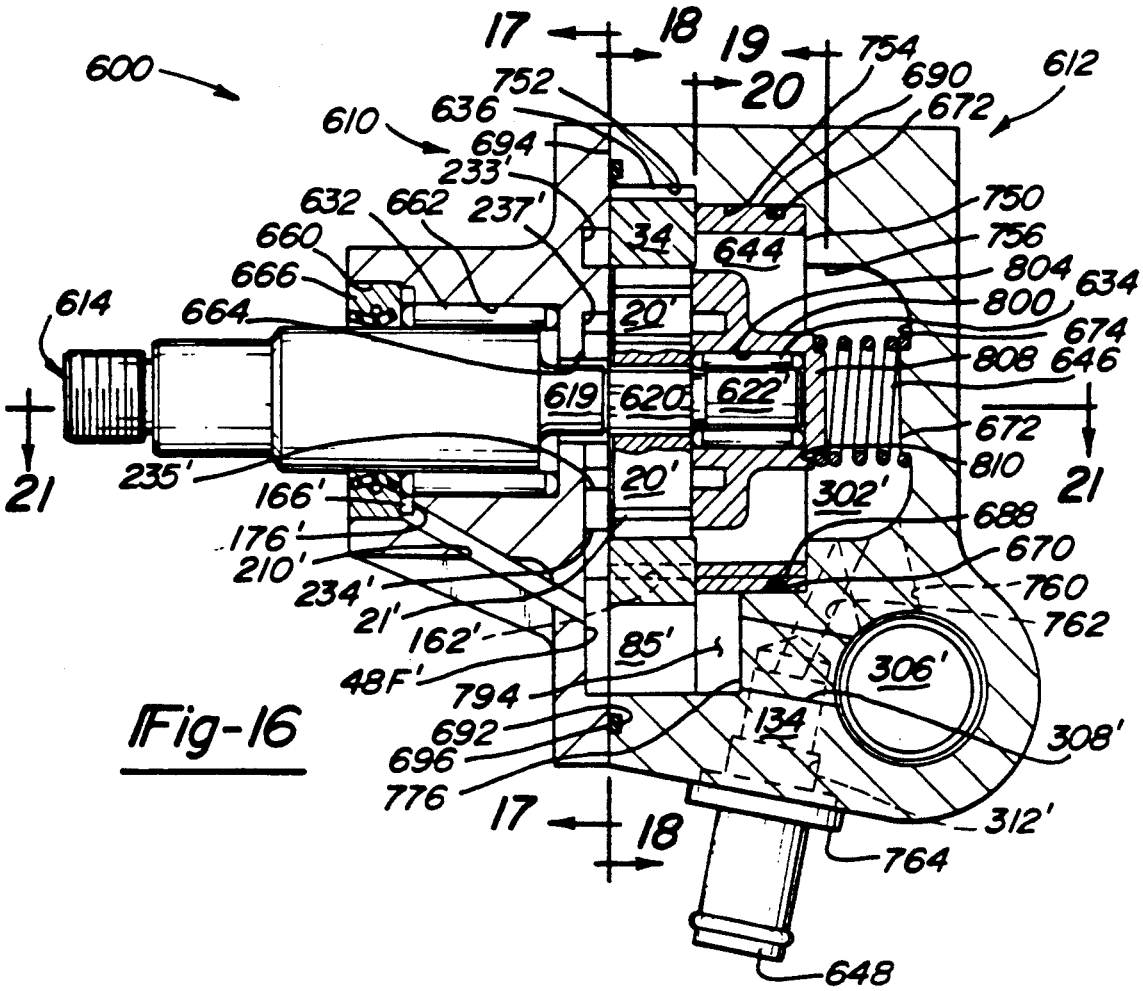
FIG. 16 is a vertical cross-section of the power steering pump of the present invention, however for illustrative purposes, the section is taken from the FIG. 5 pump taken along line 16—16 and showing some of the hydraulic passages, galleries and components in the pump housing, including a flow regulation valve, rotor, vanes and pressure plate in the rear housing section, and a set of bearings in the front section.

FIG. 16 is a vertical cross-section of the power steering pump of the present invention, however, for illustrative purposes the section cut is taken from the FIG. 5 pump of the co-pending application and is taken along line 16—16 and showing some of the hydraulic passages, galleries, and components in the rear pump housing including a flow regulation valve, rotor, vanes and a pressure plate, as well as the illustration of a pair of needle bearings and wiper seal located in the front housing section which communicate with the main drive shaft.

The pump 600 has the following primary components. A front housing section 610, a rear housing section 612, a shaft 614 rotatably mounted to the front housing section 610 via a needle bearing 632, a pump cartridge assembly 636 which includes a cam ring 34', rotor 20', and vanes 21'-29', a pressure plate 644 that is rotatably fixed to needle bearings 634 that are pressed fit into rear housing at point 622 of drive shaft 614, a spring 646, a conventional relief valve 306' and standard inlet pipe 648. It will be appreciated that plain sleeve bearings could be used in place of the needle bearings 632.

The front housing 610 has three inner diameter bores, 660, 662, and 664. Bore 660 receives a wiper seal 666 that prevents any oil from seeping outside of the pump 600 along the outer circumference of drive shaft 614. Bore 662 within front housing 610 receives needle bearing 632 which allows shaft 614 to freely rotate within the pump 600 with a relatively low degree of resistance. Bore 664 of front housing member 610 receives a narrow portion 619 of drive shaft 614. Because of the clearance between bore 464 and the outer diameter of shaft portion 619, low pressure oil is allowed to freely move through that area and two needle bearings 632 and annular volume whose outer periphery is defined by diameter 166' and stop shoulder 176' of the front housing 610, and by lip seal 666. This annular volume of low pressure oil is drained by diagonal drain line 210' connects to the wishbone gallery 85' located in the rear housing member 612.

The drive shaft 614 has a male spline portion 620 which mates with a corresponding female spline portion within rotor 20'. The outer end of shaft 614 has a portion 622 that receives the inner diameter of needle bearing 634. The outer diameter of the needle bearing 634 is pressed into the inner diameter bore 804 of pressure plate 644 thereby allowing the shaft 614 to freely rotate within the needle bearing 634. The pressure plate 644, the cam ring 34' and the pump front housing 610 are all pinned together through the use of locator pins 160' (not shown) and 162' (shown in phantom), as previously discussed and disclosed in the co-pending application (see FIGS. 7 and 9). Similarly, the pump front housing section 610 and the pump rear housing section 612 are fastened together by bolts 114' as illustrated in FIGS. 9 through 13 of the co-pending application. The front pump housing 610 also has sculpted in its face a low pressure gallery, 46F' and 48F', which feeds low pressure fluid to inlet windows 86F' and 88F' of the front housing member 610. Front housing member 610 also has high pressure blind ports 233' and 234' located in face 680 of front housing member 610. Also, front housing member 610 has undervane openings 235' through 238' located in its face 680. A more detailed discussion of these configurations located in the face 680 of front housing member 610 will be made in the discussion of FIG. 17.

The rear housing member 612 has the conventional pressure relief and control valve 306' in the co-pending application. Furthermore, a standard inlet pipe 648 is inserted within bore 312' to define an inlet passage 134' which provides fluid to rear pump housing member 612. A low pressure fluid passageway 308' delivers fluid from inlet passageway 134' to the low pressure gallery 85' of the rear housing pump 612. A groove 692 is located within the face 694 of rear housing member 612 for receiving O-ring 696.

The rear pump housing 612 also has located at the rear of the housing the pressure plate 644 which has a groove 688 in its outer periphery 690 for receiving an O-ring 670 for maintaining a tight seal against the bore 754 of the rear housing member 612. A spring 646 is provided which engages at one end a boss 672 that protrudes from an inner wall 674 located within the high pressure region 302' located within the pump rear housing member 612. The other end of the spring 646 engages an annular wall 810 of the pressure plate 644. The spring 646 provides a load against the pressure plate 644 to maintain the pressure plate in contact with cam ring 34'. As the pump 600 begins to operate, pressure builds-up in high pressure region 302' therefore exerting a force on the back-side of the pressure plate 644. When pressure in region 302' is sufficient, the tension exerted by spring 646 against pressure plate 644 is no longer needed.

Figure 17:
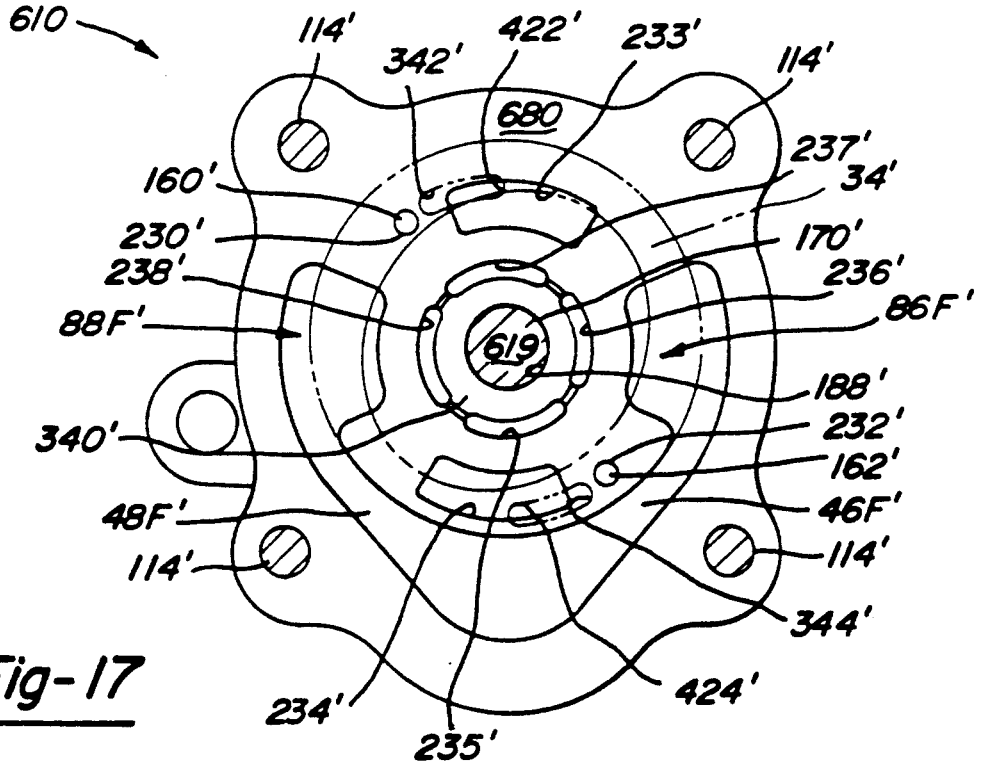
FIG. 17 is a cross-sectional view of the FIG. 16 pump taken along line 17—17 of FIG. 16 showing the high and low pressure passages provided in the inside face of the front housing section.

Referring now primarily to FIG. 17, FIG. 17 illustrates a cross-sectional view of the FIG. 16 pump taken along the line 17—17 of FIG. 16 showing the high and low pressure passages provided in the inside face 680 of the front housing section 610. This view shows the inside face 680 of the front housing section 610, particularly the relationships between the various blind openings and the cam ring 34', which is shown in phantom superimposed upon the face 680. The components that are readily identifiable within this view include the four bolts 114' and the cam ring locator pins 160' and 162' which are slidably received into blind holes 230' and 232' in the face 680 of front housing section 610. Also, the diameter 188' of the pump shaft 619 is shown centered within diameter 170' within face 680.

Kidney-shaped openings 235' through 238' of the undervane porting system are also visible, and are concentrically arranged about the diameter 170' and separated therefrom by a generally annular flat surface portion 340' of face 680. The porting to blind openings 235' thru 238' is conventionally provided through the rotating undervane holes 51' through 60' (as shown in FIG. 1) within the rotor 20'. Blind openings 233' and 234' are located in the face 680 of front housing section 610 and they feed excess oil to the kidney-shaped thru-holes 342' and 344' shown in phantom in the cam ring 34' (see FIG. 17). An overlap area 422' is defined by blind opening 233' and thru-hole 342' which allows the excess high pressure fluid to be delivered to and through the cam ring 34'. Similarly, there is an overlap area 424' that is defined by blind opening 234' and thru-hole 344' which allows excess high pressure fluid to pass through the cam ring 34'. The porting to low pressure inlet windows 86F' and 88F' is provided by galleries 46F' and 48F' which are formed within the face 680 of housing 610 to define a wishbone gallery, as discussed in detail in the co-pending application. It will appreciated that the front housing member 610 can be modified to have different configurations within its face. For example, when the thrust plate 820 is used, the y-shaped galleries 46F' and 48F' as well as the inlet windows 86F' and 88F' will be contained with the thrust plate similar to the configuration in the face 790 of the pressure plate 644. However, when such a thrust plate 820 is used, the blind openings 233' and 234', as well as undervane blind holes 235' through 238' will not be located within the face 680 of front housing number 610 because these configurations will be located within the face 822 of the thrust plate 820. For further discussion of the front housing section 610, see the detailed description of front housing member 108 of the co-pending application.

Figure 18:
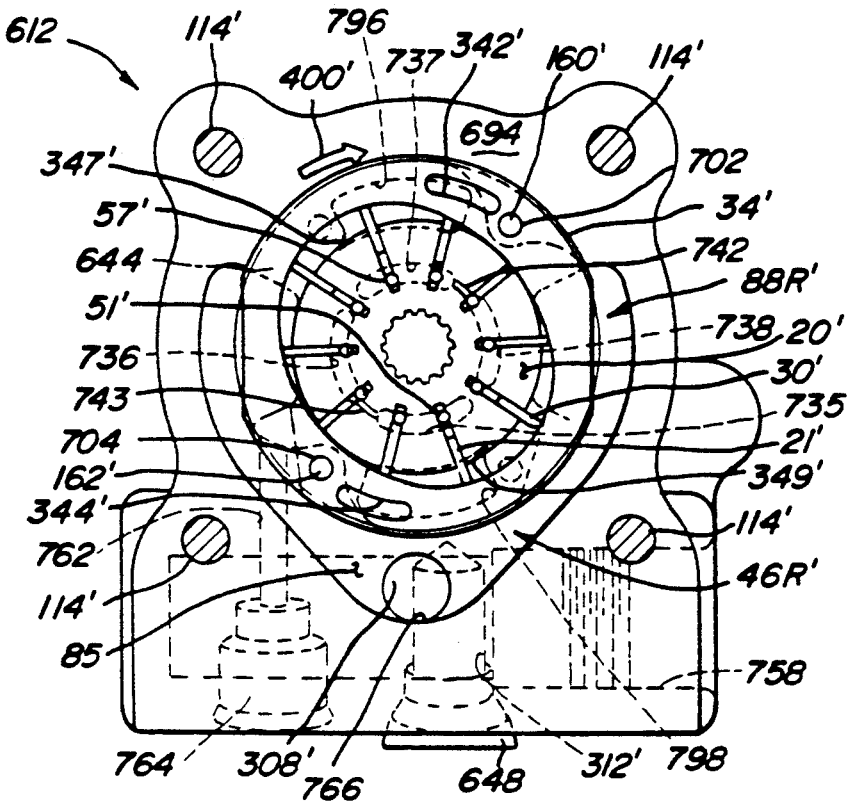
FIG. 18 is a cross-sectional view of the FIG. 16 pump taken along line 18—18 of FIG. 16 illustrating the cam ring, rotor, vanes and the locations of the high pressure and low pressure passages, in phantom, provided in the front face of the pressure plate as well as the low pressure passage provided in the inside face of the rear housing section.

FIG. 18 is a cross-sectional view of the FIG. 16 pump taken along lines 18—18 of FIG. 16 illustrating the face 694 of the rear housing section 612, the rotor 20', cam ring 34', and the thrust plate 644 shown in phantom. The direction of rotation of rotor 20' and vanes 21' through 30' with respect to face 694 is indicated by broad arrow 400'. The cam ring 34' is shown in relation to the face 694 of the rear pump housing 612 and is held in position by locator pins 160' and 162' which fits firmly within locator pin holes 702 and 704 positioned in the rear housing member 612. The rotor 20' and its vanes are illustrated in relation to the face 694 of the rear pump housing 612.

Also shown in FIG. 18 are the undervane openings 735 through 738 which are located in the pressure plate 644 and are shown in phantom and these openings provide fluid to the undervane holes 51' through 60' located in the rotor 20'. The undervane openings 736 and 738 are thru-holes and interconnect with the high-pressure fluid chamber 302' of the rear housing member 612. The top and bottom undervane holes, 737 and 735, are blind holes, that is they do not pass directly through to chamber 302'. Instead, opening 737 is connected by control orifice 742 to thru-hole 738. Likewise, blind opening 735 is connected by control orifice 743 to thru-hole 736. Additional central orifices, 744 and 745, are used to connect undervane holes 735 and 738, and 736 and 737, respectively. These control orifices, or grooves, help ensure that the vanes in the high-pressure sectors of the pump track properly and also help to reduce noise. Also shown in phantom in FIG. 18 are lead-in control or metering grooves 347' and 349' which are located in the face 740 of the pressure plate and are utilized to ensure smooth and quiet operation of the pump. The above-mentioned passages located in the pressure plate 644 can be best understood when referencing FIG. 20.

As best illustrated in FIGS. 16 and 18, the rear pump housing 612 has a major inner cavity with three distinct annular recesses, 752, 754 and 756. Annular recess 752 receives cartridge 636, and annular recess 754 receives pressure plate 644. Annular recess 756 and back wall 674 define the high pressure gallery 302' located in the rear portion of the rear housing member 612. The rear housing member 612 also has an internal horizontal passageway 758 which receives control valve 3061 and ports high pressure fluid to the flow control valve and onto the external hydraulic system. A passageway 760 is provided and communicates the high pressure gallery 302' with the high pressure side of control valve 306'. A high pressure sensor gallery 762 is provided and communicates with the high pressure gallery 302' on one end, and on the other end communicates with the inlet side of the high pressure switch 764. A low pressure passageway 308' is provided and communicates on one end with passageway 134' and at the other end communicates with discharge opening 766 that dumps low pressure fluid into gallery 85'.

Figure 19:
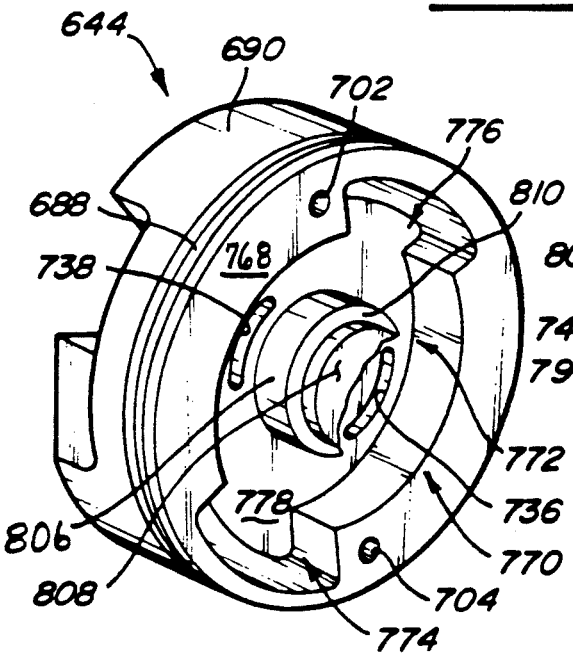
FIG. 19 is an enlarged perspective view of the FIG. 16 pump taken along line 19—19 of FIG. 16 showing the rear face of the sculpted pressure plate.

FIG. 19 illustrates an enlarged perspective view of the FIG. 16 pump taken along line 19—19 of FIG. 16 showing the rear face 768 of the sculpted pressure plate 644. The outer periphery 690 of pressure plate 644 has a groove 688 in d for receiving O-ring 670. This O-ring 670 prevents high pressure oil from seeping from high pressure gallery 302' to low pressure gallery 85' as best illustrated in FIG. 16. The back face 768 of the sculpted pressure plate 644 has a butterfly-shaped recess 770 which has a main gallery 772 and two outer galleries 774 and 776. Main gallery 772 has an annular inner wall 778 which separates the backside and the front side of the sculpted pressure plate 644. Annular wall 778 has thru-holes which are part of the undervane porting system which includes undervane openings 736 and 738 which delivers high pressure fluid from the high pressure gallery 302' to undervane openings 51' through 60' of the rotor 20'. The two outer galleries, 774 and 776, are thru-holes and communicate with high pressure holes 798 and 796 respectively.

Figure 20:
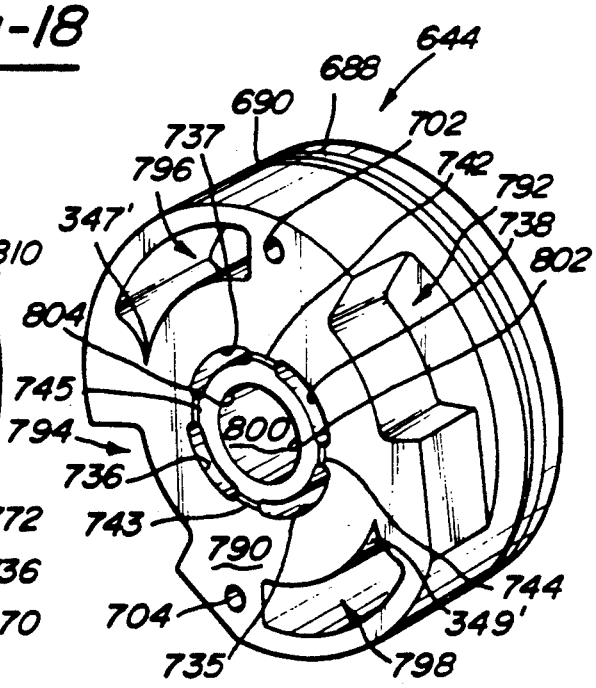
FIG. 20 is an enlarged perspective view of the FIG. 16 pump taken along line 20—20 of FIG. 16 showing the front face of the sculpted pressure plate.

FIG. 20 is an enlarged perspective view of the FIG. 16 pump taken along line 20—20 of FIG. 16 showing the front face 790 of the sculpted pressure plate 644. The high pressure communication ports 796 and 798, of the pressure plate 644 are best illustrated in FIGS. 19 and 20. These ports deliver high pressure fluid from the cam ring 34' side of pressure plate 644 and to the high pressure gallery 302' of the rear pump housing 612. High pressure port 796, as illustrated on face 790, delivers high pressure fluid to recess 776 located on the back face 768 of pressure plate 644. Similarly, high pressure port 798 begins at face 790 and extends through the pressure plate 644 and communicates with recess 774 of back face 768. During pump operation, both ports 796 and 798 continuously deliver high pressure fluid to high pressure gallery 302'.

The pressure plate 644 has a centered bore 800 which is defined by opening 802 located on face 790, inner radial wall member 804, and an end wall 808. A radial wall member 806 and an end member 808 helps define an annular surface 810 with which one end of spring member 646 communicates with. The sculpted pressure plate 644 has guide pin holes 702 and 704, as illustrated on faces 768 and 790, for receiving locator pins 160' and 162', respectively. A pair of undervane blind holes, 735 and 738, which communicate with live openings 735 and 737 via groove 743 and 742, respectively. The function of these undervane openings and grooves are the same as those discussed in the earlier application, and therefore further discussion will not be made here. Likewise, metering grooves 347' and 349' are sculpted from the face 790 and aid in the smooth, quiet operation of the balanced vane pump. The face 790 of sculpted pressure plate 644 has sculpted wishbone galleries 792 and 794 which receive low pressure fluid from low pressure gallery 851 during normal pump operation. These galleries 792 and 794 help feed low pressure fluid to the inlet windows 86R' and 88R' of the rear housing member 612.

When pump 600 begins to operate, generally pressure in the high pressure gallery 302' is insufficient to provide ample force so that face 790 maintains contact with the cam ring 34'. Therefore, spring 646 biases sculpted plate 644 by forcing against wall member 808 to ensure that face 790 maintains full contact against the cam ring 34' and provides a vane to pressure plate clearance gap of approximately a 0.0005 to 0.001 inch. As soon as pressure is sufficient in high pressure gallery 302', biasing spring 646 is no longer needed to ensure sufficient communication between face 790 and the rotor 20', vanes 21', and cam ring 34'.

FIG. 21 is a horizontal cross-sectional view of the FIG. 16 pump taken along line 21—21 of FIG. 16 showing an alternative embodiment of the balanced vane steering pump 600 utilizing a pressure plate 644 on one side of the cam ring 34' and a wear plate, or thrust plate 820, being located on the shaft side of the cam ring 34'. The embodiment illustrated in FIG. 21 utilizes the same cartridge 636 and pressure plate 644 as well as rear pump housing 612 as does the previously discussed preferred embodiment as illustrated in FIGS. 16–20. The front pump housing 610', however, has its face 680' modified to have a recess 814 shaped substantially the same as the thrust plate 820. Furthermore, face 680' has low pressure inlet windows 86F' and 88F', as well as galleries 46F'' and 48''. The recess 814 receives thrust plate 820 which has a face 822 that communicates with the cam ring. There is a gap of approximately 0.0005 to 0.001 inches between face 822 of thrust plate 820 and the rotor 20'. The front housing member 610' also illustrates diagonal drain line 210' which communicates on one end to stop shoulder 176' and at the other end to the wishbone gallery 48F'. This line in 210' is needed in order to drain low pressure oil that seeps passed shaft diameter 619 into in pass needle bearing 632 where there is an annular volume whose outer periphery is defined by diameter 166' and stop shoulders 176' of the front housing 610'.

FIG. 22 is an enlarged vertical cross-sectional view of the FIG. 21 pump taken along line 22—22 of FIG. 21 which shows the front face 822 of the thrust plate 820. Thrust plate 820 has a center bore 824 which receives shaft portion 619 of drive shaft 614. Face 822 also has four kidney-shaped undervane blind holes, 825 through 828, which each extend approximately 0.1875 inches into the thrust plate 820. The thrust plate 820 is approximately 0.250 inches thick and therefore a thin wall portion 830 remains. The blind holes 825 through 828 communicate with one another through metering grooves 854, 856, 858, and 860 in the same way that the blind openings and metering grooves communicate within the face 790 of the pressure plate 644. The face 822 of thrust plate 820 also has two diametrically opposed high pressure blind holes 832 and 834, that is, they do not extend clear through the thrust plate 820. These blind holes 832 and 834 are also approximately 0.1875 inches deep from the face 822 of the thrust plate 820. Therefore, a thin annular wall portion 830 remains. With this design, high pressure fluid is delivered to the high pressure windows 832 and 834 in the same way high pressure fluid is delivered to inlet windows 796 and 798 of the pressure plate 644. Also, high pressure fluid is delivered to undervane openings 825 through 828 by passing fluid from the pressure plate through the rotor undervane holes 51' through 60'. By providing high pressure fluid on the thrust plate side of the rotor, a more balanced operation of the pump 600 is obtained. Perhaps most importantly, thrust plate 820 has two Y-shaped galleries, 892 and 894, removed from the outer perimeter of the thrust plate which aid in delivering low pressure fluid to the inlet side of the cartridge 636. Porting to inlet windows 86T and 88T is provided by galleries 46T and 48T, respectively. Thrust plate 820 also has locator pin holes 836 and 838 that receive locator pins 160' and 162' respectively.

It will be appreciated that an alternative embodiment of the FIG. 22 thrust plate 644 could have inner passage 840 and 848 and therefore provide high pressure fluid to the undervane porting system in the thrust plate, as indicated by arrow 852.

The foregoing detailed description shows that the preferred embodiments of the present invention are well suited to fulfill the objects above-stated. It is recognized that those skilled in the art may make various modifications or additions to the preferred embodiments chosen to illustrate the present invention without departing from the spirit and proper scope of the invention. For example, the mounting arrangement for the reservoir on the pump housing may be changed. The reservoir may located alongside or even connected by hose or other fluid conduit to the pump housing. The pump may even be operated sideways or upside down from the position shown, as long as pump is kept filled with fluid, since the low pressure side and passageways of the pump are effectively charged to a slight positive pressure by the inrushing fluid dumped through the discharge port of the flow regulating valve.

The precise external shape or configuration of the pump housing is not considered important, but a configuration which helps minimize the weight of the pump housing is preferred. Of far greater importance to pump operation is providing relatively smooth and open internal concourses for the fluid to flow into the inlet ports of the pump with minimal energy losses. It is believed that by keeping abrupt changes in fluid direction or passage size to a minimum, energy loss in the form of unnecessary turbulence, can be minimized. It is also believed that a well-balanced set of low pressure passageways, exemplified by those passageways shown in FIGS. 7 through 22, and of the present invention FIGS. 16–22, helps achieve operating noise reductions.

Still other variations to the preferred embodiments to the present invention are possible. Accordingly, it is to be understood that the protection sought and to be afforded hereby should be deemed to extend to the subject matter defined by the appended claims, including all fair equivalents thereof.

We claim:

1. A balanced vane hydraulic pump for use in an automotive power steering system, comprising:

a pump housing including a substantially symmetrical wishbone-shaped gallery for balanced delivery of low pressure fluid to inlet window regions of the pump;

a pump drive shaft extending into the pump housing;

a cam ring, located within the pump housing, having a precision-machined inner surface of generally oval shape and an outer surface defining part of the wishbone-shaped gallery;

a rotor, centrally located within the oval shape of the cam ring and mechanically driven by the drive shaft, having a plurality of substantially radially arranged slots in which vanes may reciprocate while rotating with the rotor and a corresponding plurality of undervane holes;

a plurality of vanes, each vane being slidably arranged in a respective one of the slots of the rotor so as to be able to bear against the inner surface of the cam ring during operation of the balanced vane hydraulic pump; and a pressure plate, having a first side and a second side, the first side having a recessed region which forms part of the symmetrical wishbone-shaped gallery for delivery of low pressure fluid and which assist in providing smooth velocity transition of low pressure fluid to the inlet window regions, a plurality of high pressure passages for transporting high pressure fluid from high pressure discharge windows, and a plurality of holes forming part of an undervane porting system for delivering fluid to the undervane holes within the rotor.

2. A pump as in claim 1, wherein the wishbone-shaped gallery is configured for delivering low pressure hydraulic fluid to two pairs f inlet window regions, with each respective pair being located on opposite sides of the cam ring from the other pair of inlet window regions.

3. A pump as in claim 2, wherein the second side of the pressure plate has a recessed region that is generally centrally located within the circumference of the pressure plate, the recessed region of the second side having as a part thereof the plurality of high pressure passages extending through the pressure plate, the recessed region of the second side further having an interior area forming part of the undervane porting system for delivering fluid to the undervane holes within the rotor.

4. A pump as in claim 1, wherein the wishbone-shaped gallery of the pump housing and the wishbone-shaped gallery of the pressure plate together define a balanced low pressure flow and smooth velocity transition porting system located on both sides of each of the two low pressure regions within the pump.

5. A pump as in claim 4, further comprising an external reservoir for low pressure hydraulic fluid, and wherein the porting system includes a main concourse plumbed directly to the reservoir and two elongated concourses directly connected to and in fluid communication with the main concourse and respectively diverging from one another toward a respective one of the low pressure sectors of the cam ring.

6. A pump as in claim 1, wherein the pressure plate further comprises:

a recessed region of the second side which includes a pair of high pressure windows, an undervane porting system, and a centrally located means for housing a bearing;

a bearing positioned within said means for housing a bearing;

securing means for preventing the pressure plate from rotating; and means for receiving an O-ring; wherein the pressure plate is operable to provide low pressure fluid flow and smooth velocity transitions to the low pressure regions within the pump.

7. The pressure plate as in claim 6, wherein the wishbone-shaped low pressure gallery surrounds the cam ring and delivers low pressure fluid to each of the two low pressure regions within the pump.

8. The pressure plate as in claim 6, wherein the first side has metering grooves located on a leading side of each high pressure window for aiding smooth transition of high pressure fluids into the high pressure windows.

9. The pressure plate as in claim 6, wherein the undervane porting system includes four kidney-shaped undervane ports, diametrically opposed from one another, all inner connected by radial orifices located substantially between the undervane ports, whereby two of the undervane ports are through-holes which communicate with the second side of the pressure plate.

10. The pressure plate as in claim 6, wherein the means for housing bearing axially extends a radial wall rising within the recessed region, the radial wall at its outer end having a recess for receiving a pressure plate spring.

11. A balanced vane hydraulic pump for use in an automotive power stearing system, comprising:

a pump housing including a first housing section and a second housing section, the first housing section including a wishbone-shaped gallery for delivery of low pressure fluid to inlet window regions of the pump, and the second housing section having a high pressure gallery;

a pressure plate located within the housing and having a recessed region connected to the wishbone-shaped gallery for delivery of low pressure fluid with smooth fluid velocity transition;

a pump drive shaft extending to the first housing section and into the pressure plate;

a cam ring, located within the pump housing, having a machined inner surface of generally oval shape;

a rotor generally disposed in a central location within the cam ring, having a plurality of slots in which vanes may move while rotating in unison with the rotor;

a plurality of vanes, with one vane slidably arranged in each of the slots of the rotor so as to be able to bear against the inner surface of the cam ring during operation of the pump;

spring means, located within the pump housing, for biasing against the pressure plate; and low pressure passage means, formed in the pump housing and the pressure plate, for providing ports and concourses to deliver low pressure hydraulic fluid to four inlet window locations adjacent to two pressure sectors of the cam ring located on opposite sides of the drive shaft.

12. A pump as in claim 6, wherein the pressure plate is located within the second housing section opposite the shaft side of the cam ring, and wherein said wishbone-shaped low pressure gallery surrounds the cam ring for delivering low pressure fluid to each of the two low pressure regions within the pump.

13. A pump as in claim 11, wherein the pressure plate includes a high pressure passage means for delivering high pressure hydraulic fluid from the cam ring to the high pressure gallery of the second housing section.

14. A pump as in claim 11, wherein the pump further comprises:

a thrust plate located on the shaft side of the cam ring, the thrust plate having two undercut regions forming part of the wishbone-shaped gallery for balancing low pressure fluids, the pressure plate further having a blind high pressure window for receiving high pressure fluid, and an undervane porting system which communicates with the undervane holes within the rotor.

15. A pump as in claim 11, wherein the first and second housing sections, the pressure plate, and the thrust plate, each have a substantially similar in configuration low pressure passage means which together define a balanced low pressure flow and smooth velocity transition porting system located on both sides of each of the two low pressure regions within the pump.

16. A pump as in claim 10, further comprising:

a high pressure passage means, arranged as four discharged window regions interconnected by elongated concourses, for delivering high pressure hydraulic fluid discharging from four outlet window locations in two high pressure sectors of the cam ring to the resulting valve located on opposite sides of the drive shaft.

17. A balanced vane hydraulic pump for use in an automotive power steering system, comprising:

a pump housing including a first housing section and a second housing section, said first housing section including a substantially symmetrical wishbone-shaped gallery for balanced delivery of low pressure fluid to inlet window regions of the pump;

a pressure plate located within one of said housing sections, the pressure plate having a recessed region which forms part of the symmetrical wishbone-shaped gallery;

a pump drive shaft extending to the first housing section and within the pressure plate;

a cam ring, located within the pump housing, having a machined inner surface of generally oval shape;

a rotor generally disposed in a central location within the cam ring, having a plurality of slots in which vanes may move while rotating in unison with the rotor;

a plurality of vanes, with one vane slidably arranged in each of the slots of the rotor so as to be able to bear against the inner surface of the cam ring during operation of the pump assembly;

spring means, located within the pump housing, for biasing against the pressure plate; and a thrust plate located on the shaft side of the cam ring, the thrust plate having a recessed region which forms part of the symmetrical wishbone-shaped gallery which is operable as an inlet port for balancing low pressure fluids, a blind high pressure window for receiving high pressure fluid, and an undervane porting system which communicates with the undervane holes within the rotor.

18. A pump as in claim 17, wherein the first and second housing sections, the pressure plate, and the thrust plate, each have a substantially similar in configuration low pressure passage means which together defines a balanced low pressure flow and smooth velocity transition porting system located on both sides of each of the two low pressure regions within the pump.

19. A pump as in claim 18, further comprising an external reservoir for low pressure hydraulic fluid, and wherein the porting system includes a main concourse plumbed directly to the reservoir and two elongated concourses directly connected to and in fluid communication with the main concourse and respectively diverging from one another toward a respective one of the low pressure sectors of the cam ring.

20. A pump as in claim 19, wherein the portion of each elongated concourses of the wishbone-shaped gallery downstream from the main concourse diverge in longitudinal cross-section in order to enable delivery of low pressure fluid to a pair of inlet window locations on opposite sides of the cam ring.

21. A pump as in claim 17, further comprising: 'a high pressure passage means, arranged as four discharged window regions interconnected by elongated concourses, for delivering high pressure hydraulic fluid discharging from four outlet window locations in two high pressure sectors of the cam ring to the regulating valve located on opposite sides of the drive shaft.

* * * * *

UNITED STATES PATENT AND TRADEMARK OFFICE

CERTIFICATE OF CORRECTION

PATENT NO. : 5,290,155

DATED : March 1, 1994

INVENTOR(S) : Snow et al.

It is certified that error appears in the above-identified patent and that said Letters Patent is hereby corrected as shown below:

On the title page, Item [54] and Col. 1, lines 2-3 BALANCED PORTING should be, --RECESSED PRESSURE PLATE--.

On the title page, under Abstract, line 20, "aides" should be --aids--.

Column 1, lines 37-40, delete "The direction of pressure outlet ports or "windows" 42 and 44 are shown in dashed lines at the top and bottom of the cam ring diametrically opposite to one another.".

Column 2, line 38, "ft" should be --it--.

Column 3, line 27, "furl" should be --fulfill--.

Column 9, line 31, "shows" should be --show--.

Column 10, line 3, "ft" should be --it--.

Column 11, line 8, "22" should be --422--.

Column 11, line 25, "or" should be --of--.

Column 11, line 50, "ft" should be --it--.

Column 15, line 61, "3061" should be --306'--.

Column 16, line 10, "d" should be --it--.

UNITED STATES PATENT AND TRADEMARK OFFICE

CERTIFICATE OF CORRECTION

PATENT NO. : 5,290,155

DATED : March 1, 1994

INVENTOR(S) : Snow et al.

It is certified that error appears in the above-identified patent and that said Letters Patent is hereby corrected as shown below:

Column 16, line 61, "851" should be --85'--.

Column 17, line 22, "86F' and 88F'" should be --86F" and 88F"--.

Column 17, line 31, "passed" should be --past--.

Column 19, line 16, "f" should be "of".

Column 20, line 7, Claim 10 after "housing" insert --a--.

Column 20, line 12, "stearing" should be --steering--.

Column 20, line 44, "6" should be --11--.

Column 21, line 9, "the resulting" should be --a regulating--.

Column 22, line 10, "defines" should be --define--.

Column 22, line 30, delete """.

Signed and Sealed this

Second Day of May, 1995

*Attest:*

*Attesting Officer*

BRUCE LEHMAN

*Commissioner of Patents and Trademarks*